US009361846B2

(12) United States Patent
Ryu et al.

(10) Patent No.: US 9,361,846 B2
(45) Date of Patent: Jun. 7, 2016

(54) CHARGE SHARING METHOD FOR REDUCING POWER CONSUMPTION AND APPARATUSES PERFORMING THE SAME

(71) Applicant: Samsung Electronics Co., Ltd., Suwon-si (KR)

(72) Inventors: Seong Young Ryu, Seoul (KR); Hyun Sang Park, Seongnam-si (KR); Kyung Chun Kim, Hwaseong-si (KR)

(73) Assignee: SAMSUNG ELECTRONICS CO., LTD., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/249,953

(22) Filed: Apr. 10, 2014

(65) Prior Publication Data

US 2014/0320464 A1 Oct. 30, 2014

(30) Foreign Application Priority Data

Apr. 29, 2013 (KR) ..... 10-2013-0047666

(51) Int. Cl.
*G09G 3/36* (2006.01)

(52) U.S. Cl.
CPC ..... *G09G 3/3688* (2013.01); *G09G 3/3614* (2013.01); *G09G 2310/0248* (2013.01); *G09G 2320/103* (2013.01)

(58) Field of Classification Search
CPC . G09G 3/3614; G09G 2310/0243–2310/0259; G09G 2330/023
See application file for complete search history.

(56) References Cited

U.S. PATENT DOCUMENTS

| | | | |
|---|---|---|---|
| 6,058,461 | A | 5/2000 | Lewchuk et al. |
| 6,549,186 | B1 | 4/2003 | Kwon |
| 7,573,448 | B2 | 8/2009 | Credelle et al. |
| 7,847,777 | B2 | 12/2010 | Choi |
| 7,928,949 | B2 | 4/2011 | Kim et al. |
| 8,031,146 | B2 | 10/2011 | Park et al. |
| 8,269,707 | B2 | 9/2012 | Woo et al. |

(Continued)

FOREIGN PATENT DOCUMENTS

| | | | |
|---|---|---|---|
| KR | 10-2011-0063242 | A | 6/2011 |
| KR | 10-2012-0096777 | A | 8/2012 |

OTHER PUBLICATIONS

European Search Report for related application EP 13161227.7 dated May 9, 2014.

(Continued)

*Primary Examiner* — Gene W Lee
(74) *Attorney, Agent, or Firm* — Muir Patent Law, PLLC

(57) ABSTRACT

A charge sharing method, device, and system is disclosed. For example, a charge sharing method for a display driver is disclosed. The method includes: receiving a first row of data for a first row of source lines; receiving a second row of data for a second row of source lines; for each source line of at least a first group of the source lines, determining whether a change amount between data for that source line from the first row of data and data for that source line from the second row of data is above a threshold; and performing selective charge sharing based on the determinations.

17 Claims, 25 Drawing Sheets

(56) References Cited

U.S. PATENT DOCUMENTS

| | | | | |
|---|---|---|---|---|
| 8,456,464 | B2 * | 6/2013 | Hsu | G09G 3/3611 345/209 |
| 8,552,962 | B2 * | 10/2013 | Otani | G09G 3/3688 345/101 |
| 8,994,707 | B2 * | 3/2015 | Kim | G09G 3/20 345/209 |
| 2003/0005239 | A1 | 1/2003 | Dover | |
| 2004/0252098 | A1 | 12/2004 | Lee et al. | |
| 2006/0001630 | A1 * | 1/2006 | Chen | G09G 3/3688 345/96 |
| 2006/0262069 | A1 * | 11/2006 | Do et al. | 345/98 |
| 2008/0136806 | A1 | 6/2008 | Lee et al. | |
| 2010/0265234 | A1 * | 10/2010 | Fukuo | 345/211 |
| 2011/0090190 | A1 | 4/2011 | Lin | |
| 2011/0164006 | A1 | 7/2011 | Son et al. | |
| 2011/0248985 | A1 | 10/2011 | Lin et al. | |
| 2011/0310080 | A1 | 12/2011 | Tonomura | |
| 2011/0316823 | A1 * | 12/2011 | Otani | G09G 3/3688 345/204 |
| 2012/0162165 | A1 | 6/2012 | Lee et al. | |
| 2012/0169783 | A1 | 7/2012 | Park | |
| 2012/0169788 | A1 * | 7/2012 | Jang | G09G 3/3614 345/690 |
| 2013/0257917 | A1 * | 10/2013 | Peng | G09G 3/20 345/690 |
| 2014/0071188 | A1 * | 3/2014 | Oh | G09G 3/3696 345/691 |
| 2014/0210804 | A1 * | 7/2014 | Liao et al. | 345/209 |

OTHER PUBLICATIONS

Eugenie Ip, "High Performance TFT LCD Driver IDs for Large-Size Displays," Solomon Systech Limited, pp. 1-9.

Fujitsu, "Fundamentals of Liquid Crystal Displays— How They Work and What They Do," Fujitsu Microelectronics America, Inc., White Paper, pp. 1-14, Aug. 2006.

* cited by examiner

| MSB N-line | MSB N+1-line | CS_EN |
|---|---|---|
| 0 | 0 | OFF |
| 0 | 1 | ON |
| 1 | 0 | ON |
| 1 | 1 | OFF |

CHARGE SHARING METHOD FOR REDUCING POWER CONSUMPTION AND APPARATUSES PERFORMING THE SAME

CROSS-REFERENCE TO RELATED APPLICATION

This application claims priority under 35 U.S.C. §119(a) from Korean Patent Application No. 10-2013-0047666 filed on Apr. 29, 2013, the disclosure of which is hereby incorporated by reference in its entirety.

BACKGROUND

The present disclosure relates to a charge sharing technology for Liquid Crystal Displays (LCDs).

A Liquid Crystal Display (LCD) has been widely used in portable electronic devices, e.g., mobile phones, tablet personal computers (PCs), or other portable devices. An LCD driver typically drives an LCD display, and may include a column driver, row driver, and a timing controller. Low power consumption and high display quality have been increasingly demanded in LCD devices.

An LCD panel is typically driven according to an inversion driving method, e.g., a frame inversion method, a line or column inversion method, or a dot inversion method, in order to improve a display quality and prevent a liquid crystal material from deteriorating. Examples of these methods can be seen, for example, in U.S. Pat. No. 7,573,448, and U.S. Pat. No. 8,269,707, both of which are incorporated herein by reference in their entirety.

Because dot inversion compensates flicker occurring in a horizontal direction and in a vertical direction, driving the LCD panel based on the dot inversion method may improve a display quality compared to other inversion methods.

However, due to a lot of fluctuation in the voltage amount of display data signals supplied to a column driver, the LCD panel driven in the typical dot inversion method has considerably large power dissipation.

Charge sharing is one way that some LCD drivers reduce power dissipation. In a charge sharing scheme, source lines in a display driver are electrically connected to each other at certain time periods. An example of a charge sharing system and method is described in U.S. Pat. No. 7,928,949, which is incorporated herein by reference in its entirety.

The embodiments disclosed herein relate to an improved system and method for charge sharing in an LCD driver.

SUMMARY

In one embodiment, a charge sharing method for a display driver that uses Z-inversion is disclosed. The method includes: receiving a first row of data for a plurality of source lines; receiving a second row of data for the plurality of source lines; for each source line of the plurality of source lines, determining whether a change amount between data for that source line from the first row of data and data for that source line from the second row of data is above a threshold; and controlling whether to perform charge sharing among a first group of source lines of the plurality of source lines based on the determinations for that first group of source lines.

In one embodiment, the method further includes controlling whether to perform charge sharing among a second group of source lines of the plurality of source lines based on the determinations for that second group of source lines.

The first group of source line may include only odd-numbered source lines of the display driver; and the second group of source line may include only even-numbered source lines of the display driver.

The first group of source lines may include source lines that share a first polarity during operation of the source driver; and the second group of source lines may include source lines that share a second polarity opposite the first polarity during operation of the source driver.

In one embodiment, the method further includes dynamically selecting the first group of source lines based on the determinations for the plurality of source lines.

The method may additionally include counting a first number of determinations for which a charge associated with the data for a respective source line increases more than a first threshold amount; counting a second number of determinations for which a charge associated with the data for a respective source line decreases more than a second threshold amount; and controlling whether to perform the charge sharing for the first group of source lines based on the first number of determinations and the second number of determinations.

In one embodiment, the method additionally includes performing the charge sharing when the first number of determinations is above a first reference value and the second number of determinations is above a second reference value. The first reference value may be the same as the second reference value.

In one embodiment, the first reference value is a predetermined percentage of the total number of source lines of the first group of source lines; and the second reference value is a predetermined percentage of the total number of source lines of the first group of source lines.

According to another embodiment, a charge sharing method for a display driver is disclosed. The method includes: receiving a first row of data for a first row of source lines; receiving a second row of data for a second row of source lines; for each source line of at least a first group of the source lines, determining whether a change amount between data for that source line from the first row of data and data for that source line from the second row of data is above a threshold; and performing selective charge sharing based on the determinations.

Performing selective charge sharing may include selecting whether or not to perform charge sharing based on the determinations.

Performing selective charge sharing may further include, during each of a plurality of blanking intervals, selecting whether or not to perform charge sharing.

In one embodiment, performing selective charge sharing includes selecting a group of source lines to be connected to each other for a charge sharing operation.

In one embodiment, for each source line of at least a second group of the source lines, determining whether a change amount between data for that source line from the first row of data and data for that source line from the second row of data is above a threshold, wherein: the first group of source lines includes only odd-numbered source lines of the display driver; and the second group of source lines includes only even-numbered source lines of the display driver.

In one embodiment, for each source line of at least a second group of the source lines, determining whether a change amount between data for that source line from the first row of data and data for that source line from the second row of data is above a threshold, wherein: the first group of source lines includes source lines that share a first polarity during operation of the source driver; and the second group of source lines includes source lines that share a second polarity opposite the first polarity during operation of the source driver.

In one embodiment, based on the determinations for the first group of source lines: counting a first number of determinations for which a charge associated with the data for a respective source line increases more than a first threshold amount; counting a second number of change amounts for which a charge associated with the data for a respective source line decreases more than a second threshold amount; and controlling whether to perform the charge sharing for the first group of source lines based on the first number of determinations and the second number of determinations.

The charge sharing may be performed when the first number of determinations is above a first reference value and the second number of determinations is above a second reference value. In one embodiment, the first reference value is the same as the second reference value.

According to another embodiment, a charge sharing method for a display driver is disclosed. The display driver includes a plurality of first source lines coupled to a respective plurality of first buffers through a respective plurality of first switches, a plurality of second source lines coupled to a respective plurality of second buffers through a respective plurality of second switches, a plurality of third switches respectively coupled to the plurality of first buffers and a plurality of fourth switches respectively coupled to the plurality of second buffers, a first charge sharing line, and a second charge sharing line. The method includes: receiving a first set of data at the plurality of first source lines and a second set of data at the plurality of second source lines at a first period of time when each of the plurality of third switches and each of the plurality of fourth switches are in a first state that causes the first charge sharing line and the second charge sharing line to be disconnected from the plurality of first source lines and plurality of second source lines; and changing the state of each of the plurality of third switches and each of the plurality of fourth switches to a second state to cause the plurality of first source lines to connect to the first charge sharing line and the plurality of second source lines to connect to the second charge sharing line.

The changed state of each of the plurality of first switches and each of the plurality of second switches may occur during a blanking interval following the first period of time.

The method may include selectively determining whether to change the states of the plurality of first switches and plurality of second switches during selected blanking intervals. In one embodiment, the selectively determining is based on the first set of data received at the plurality of first source lines and the second set of data received at the plurality of second source lines at the first period of time, and a third set of data received at the plurality of first source lines and a fourth set of data received at the plurality of second source lines at a second period of time. The selectively determining may be based on respective change amounts between the first set of data and the second set of data, and respective change amounts between the third set of data and the fourth set of data.

In one embodiment, a source driver is disclosed. The source driver includes a plurality of first source lines coupled to a respective plurality of first buffers through a respective plurality of first switches; a plurality of second source lines coupled to a respective plurality of second buffers through a respective plurality of second switches; a first charge sharing line coupled to the plurality of first source lines through a plurality of respective third switches; and a second charge sharing line coupled to the plurality of second source lines through a plurality of respective fourth switches. The coupling between the first charge sharing line and the plurality of first source lines is independent from the coupling between the second charge sharing line and the plurality of second source lines.

In one embodiment, the plurality of first source lines are odd-numbered source lines, and the plurality of second source lines are even-numbered source lines. The plurality of first source lines may be for connecting to a display panel in a Z-inversion configuration, and the plurality of second source lines may be for connecting to the display panel in a Z-inversion configuration.

In one embodiment, the display driver further includes: circuitry for receiving a first set of data at the plurality of first source lines and a second set of data at the plurality of second source lines at a first period of time when each of the plurality of third switches and each of the plurality of fourth switches are in a first state that causes the first charge sharing line and the second charge sharing line to be disconnected from the plurality of first source lines and plurality of second source lines; and circuitry for changing the state of each of the plurality of third switches and each of the plurality of fourth switches to a second state to cause the plurality of first source lines to connect to the first charge sharing line and the plurality of second source lines to connect to the second charge sharing line.

The display driver may further include circuitry that causes the changed state of each of the plurality of first switches and each of the plurality of second switches to occur during a blanking interval following the first period of time.

The display driver may further include circuitry configured to selectively determine whether to change the states of the plurality of first switches and plurality of second switches during selected blanking intervals.

In one embodiment, the selectively determining is based on the first set of data received at the plurality of first source lines and the second set of data received at the plurality of second source lines at the first period of time, and a third set of data received at the plurality of first source lines and a fourth set of data received at the plurality of second source lines at a second period of time.

In one embodiment, the selectively determining is based on respective change amounts between the first set of data and the second set of data, and respective change amounts between the third set of data and the fourth set of data.

A display system is also disclosed. In one embodiment, the display system includes: a row driver; a source driver; and a controller coupled to the row driver and the source driver. The source driver includes: a plurality of first source lines coupled to a respective plurality of first buffers through a respective plurality of first switches; a plurality of second source lines coupled to a respective plurality of second buffers through a respective plurality of second switches; a first charge sharing line coupled to the plurality of first source lines through a plurality of respective third switches; and a second charge sharing line coupled to the plurality of second source lines through a plurality of respective fourth switches. The coupling between the first charge sharing line and the plurality of first source lines is independent from the coupling between the second charge sharing line and the plurality of second source lines.

In one embodiment, the plurality of first source lines are odd-numbered source lines, and the plurality of second source lines are even-numbered source lines.

In one embodiment, the plurality of first source lines are for connecting to a display panel in a Z-inversion configuration, and the plurality of second source lines are for connecting to the display panel in a Z-inversion configuration.

DETAILED DESCRIPTION OF EMBODIMENTS

Figure 1:
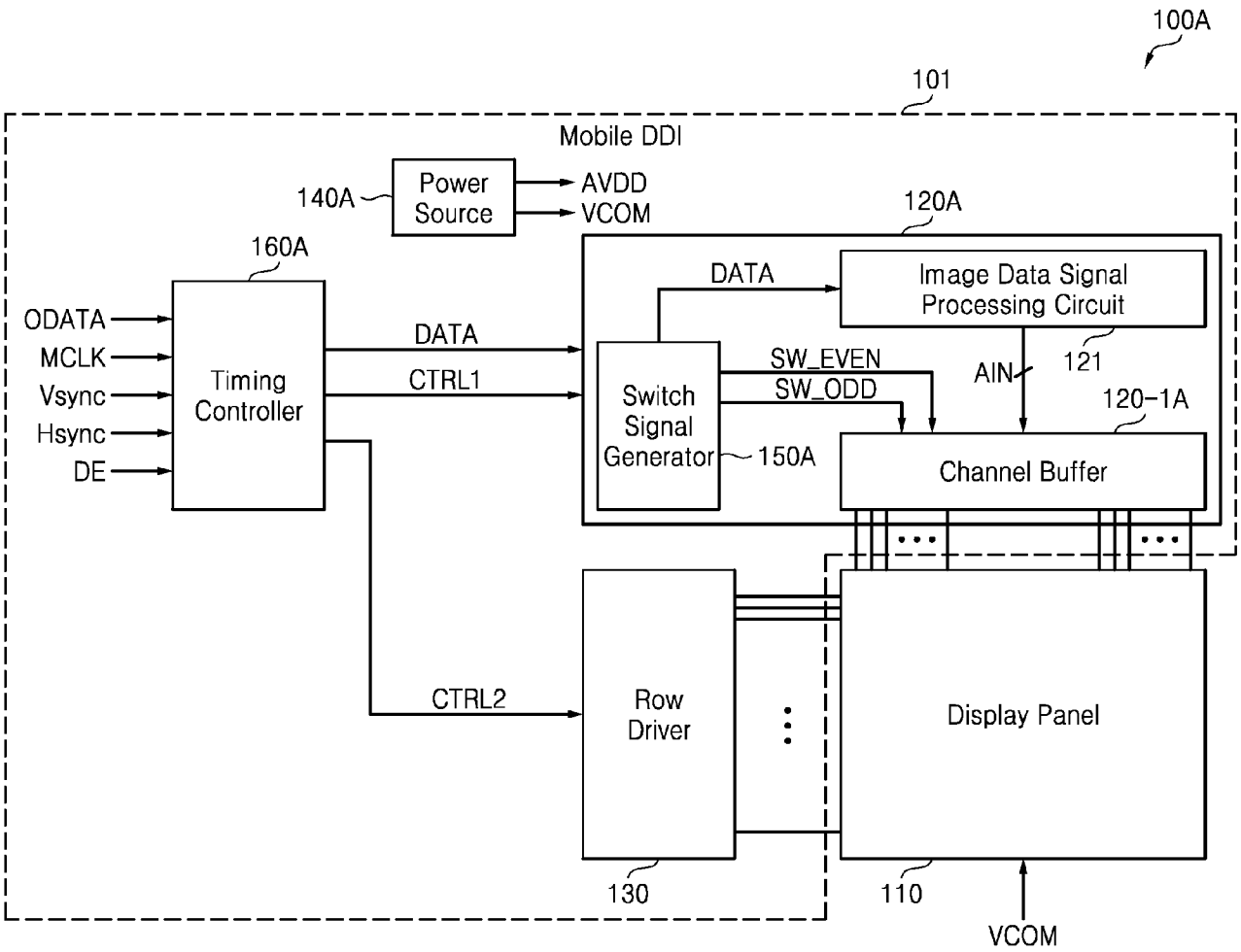
FIG. 1 is a block diagram illustrating an example embodiment of a display module which may perform a z-inversion-charge sharing method according to an example embodiment.

The present disclosure now will be described more fully hereinafter with reference to the accompanying drawings, in which various embodiments are shown. The invention may, however, be embodied in many different forms and should not be construed as limited to the embodiments set forth herein. In the drawings, the size and relative sizes of layers and regions may be exaggerated for clarity. Like numbers refer to like elements throughout.

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. Unless indicated otherwise, these terms are only used to distinguish one element from another. For example, a first chip could be termed a second chip, and, similarly, a second chip could be termed a first chip without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

The below embodiments describe a number of different charge sharing schemes for reducing the power usage and dissipation in an LCD system. In certain embodiments, a Z-inversion method is proposed to reduce the power dissipation. The Z-inversion method provides a display quality similar to the display quality provided according to the dot inversion method, and a column driver driven according to the Z-inversion method significantly decreases in power consumption compared to a column driver driven according to the dot inversion method. Although a Z-inversion method is described in detail below, certain aspects of the disclosed embodiments may equally apply to other types of inversion, such as column inversion, for example.

FIG. 1 is a block diagram illustrating an example embodiment of a display module which may perform a Z-inversion-charge sharing method according to an example embodiment.

Referring to FIG. 1, a display module 100A includes a display panel 110, a source driver 120A, a row driver 130, a power source 140A, and a timing controller 160A.

The display panel 110 includes a plurality of data lines, a plurality of gate (or row) lines, and a plurality of pixels. The display panel 110 may be embodied, for example, in a thin film transistor-liquid crystal display (TFT-LCD), a light emitting diode (LED) display, an organic LED (OLED) display, an active-matrix OLED (AMOLED) display, or a flexible display.

For example, the display panel 110 may be embodied so as to be suitable for a Z-inversion method, such that each source line is electrically connected to pixels in alternating columns in consecutive rows (in a z-shaped pattern), and during operation those source lines connect to pixels that share a same polarity. However, the display panel 110 may also be configured for a dot inversion method, a column inversion method, or a combination of dot inversion, column inversion and Z-inversion.

Using a Z-inversion method as an example, the source driver 120A may supply image data DATA which is suitable for the Z-inversion method to the display panel 110.

In one embodiment, the source driver 120A includes a channel buffer 120-1A, an image data signal processing circuit 121, and a switch signal generator 150A.

The channel buffer 120-1A performing a function of an output circuit may drive image signals AIN with data lines of the display panel 110.

The image data signal processing circuit 121 processes image data DATA, and generates image signals AIN which may be processed by buffers included in the channel buffer 120-1A. The image data DATA may be, for example, RGB data, YUV data, or YCoCg data. For example, the image data signal processing circuit 121 may generate analog image signals AIN corresponding to digital image data DATA.

According to an example embodiment, the switch signal generator 150A may generate charge sharing switch signals SW_ODD and/or SW_EVEN based on a change amount between image data (or image data signals) in a previous line of image data DATA and image data (or image data signals) in a current line of the image data DATA. For example, the change amount may be calculated on a basis of an image data signal corresponding to a pixel. The image data signal may include a plurality of bits, some or all of which indicate a level of intensity for the pixel.

In one embodiment, for example, the switch signal generator 150A may compare upper bits of each of image data signals included in the previous line of the image data DATA and upper bits of each of image data signals included in the current line of the image data DATA, calculate the number of image data signals which do not accord with each other based on a result of the comparison, and output the count value.

The switch signal generator 150A may compare the count value to a reference value, and control whether or not to activate each of the charge sharing switch signals SW_ODD and/or SW_EVEN according to a result of the comparison.

For example, when the count value indicating a number of change amounts of a certain type is greater than the reference value, for example, when the number of change amounts of the certain type calculated on a basis of the image data signal is large or a dynamic power ratio is high, the switch signal generator 150A may generate each of the charge sharing switch signals SW_ODD and/or SW_EVEN which are activated to control a charge sharing operation.

However, when the count value is smaller than the reference value, for example, when the number of change amounts of a certain type calculated on the basis of an image data signal is small or a dynamic power ratio is low, the switch signal generator 150A may generate each of the charge sharing switch signals SW_ODD and/or SW_EVEN which are not activated.

For example, the switch signal generator 150A may compare each most significant bit (MSB) of image data signals included in a previous line of image data DATA and each most significant bit (MSB) of image data signals included in a current line of the image data DATA, and output a count value based on a result of the comparison. As described further below, more than one count value may be generated for more than one type of comparison result.

The switch signal generator 150A may transmit image data DATA to the image data signal processing circuit 121.

The row driver 130, which may be referred to as a gate driver, drives each of the row lines of the display panel 110. According to a control of the source driver 120A and the row driver 130, the display panel 110 may display an image corresponding to the image data DATA.

In one embodiment, the power source 140A generates a first operation voltage AVDD and a common voltage VCOM. The first operation voltage AVDD is supplied to the source driver 120A, and the common voltage VCOM is supplied to the display panel 110.

The timing controller 160A may generate at least one first control signal CTRL1 used for an operation of the source driver 120A and at least one second control signal CTRL2 used for an operation of the row driver 130 in response to control signals such as a master clock signal MCLK, a vertical synchronization signal Vsync, a horizontal synchronization signal Hsync, and a data enable signal DE.

The timing controller 160A may process original image data ODATA, and transmit image data DATA generated based on a result of the processing to the source driver 120A.

According to an example embodiment, the timing controller 160A may supply the image data and a clock signal to the source driver 120A through a serial interface. The clock signal may be a master clock signal MCLK itself or an additional clock signal generated based on the master clock signal MCLK.

A display driver integrated circuit (DDI), e.g., a mobile DDI 101, may include the source driver 120A, the row driver 130, the power source 140A, and the timing controller 160A.

Figure 2:
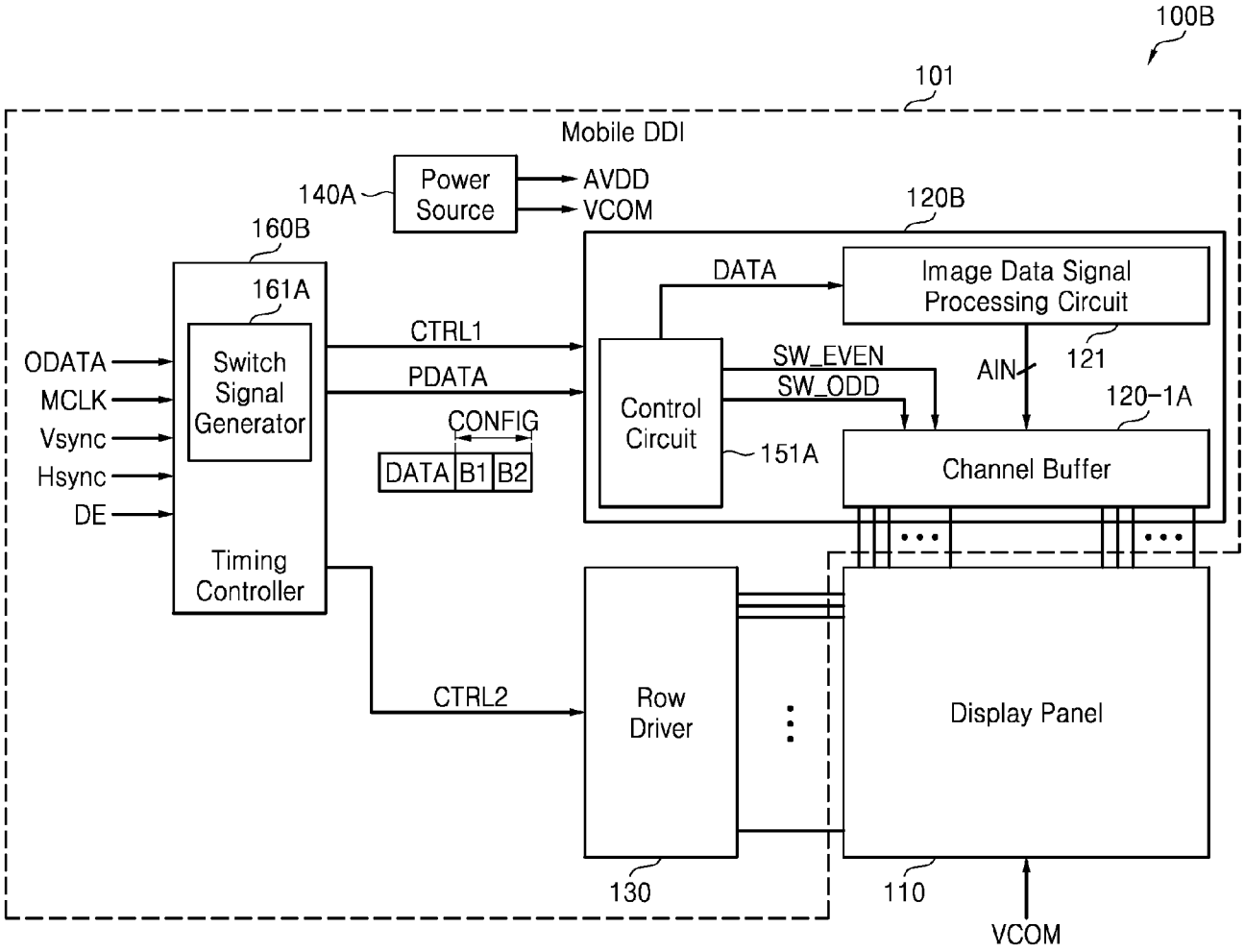
FIG. 2 is a block diagram illustrating another example embodiment of the display module which may perform a z-inversion-charge sharing method according to an example embodiment.

FIG. 2 is a block diagram illustrating another example embodiment of the display module which may perform a Z-inversion charge sharing method according to an example embodiment.

Except for a timing controller 160B including a switch signal generator 161A, and a source driver 120B including a control circuit 151A interpreting or analyzing a data packet PDATA, a structure and an operation of the display module 100A in FIG. 1 are substantially the same as a structure and an operation of a display module 100B in FIG. 2.

In one embodiment, the switch signal generator 161A compares upper bits of each of image data signals included in a previous line of original image data ODATA and upper bits of each of image data signals included in a current line of the original image data ODATA, counts the number of image data signals which do not accord with each other based on a result of the comparison, and outputs a count value.

The switch signal generator 161A compares the count value and a reference value and generates indication bits B1 and B2 based on a result of the comparison. As will be described further below, one or more count values may be determined and compared to respective reference values.

According to an example embodiment, when a control circuit 151A is not embodied inside the source driver 120B, charge sharing switch signals SW_ODD and SW_EVEN generated by a switch signal generator 161A embedded in a timing controller 160B may be directly supplied to a source driver 120B.

According to another example embodiment, when the control circuit 151A is embodied inside the source driver 120B, a data packet PDATA generated by the timing controller 160B may include image data DATA and two indication bits B1 and B2.

According to example embodiments, a transmission sequence of the image data DATA and two indication bits B1 and B2 may be variously changed. For example, the data packet PDATA may be transmitted through enhanced reduced voltage differential signaling (eRVDS) and so on.

Two indication bits B1 and B2 may be included in a configuration field CONFIG of the data packet PDATA. In one embodiment, a first indication bit B1 indicates whether to activate a first charge sharing switch signal SW_ODD, and a second indication bit B2 indicates whether to activate a second charge sharing switch signal SW_EVEN.

The control circuit 151A may interpret or analyze two indication bits B1 and B2 included in the data packet PDATA, and generate the charge sharing switch signals SW_ODD and SW_EVEN based on a result of the interpretation or the analyzing. The control circuit 151A may transmit image data DATA included in the data packet PDATA to the image data signal processing circuit 121.

The DDI 101 may include the source driver 120B, the row driver 130, the power source 140A, and the timing controller 160B.

Therefore, as illustrated in FIGS. 1 and 2, different circuit configurations may be used to implement the result of selecting which signal or signals of the first charge sharing switch signal SW_ODD and the second charge sharing switch signal SW_EVEN should be activated.

Figure 3:
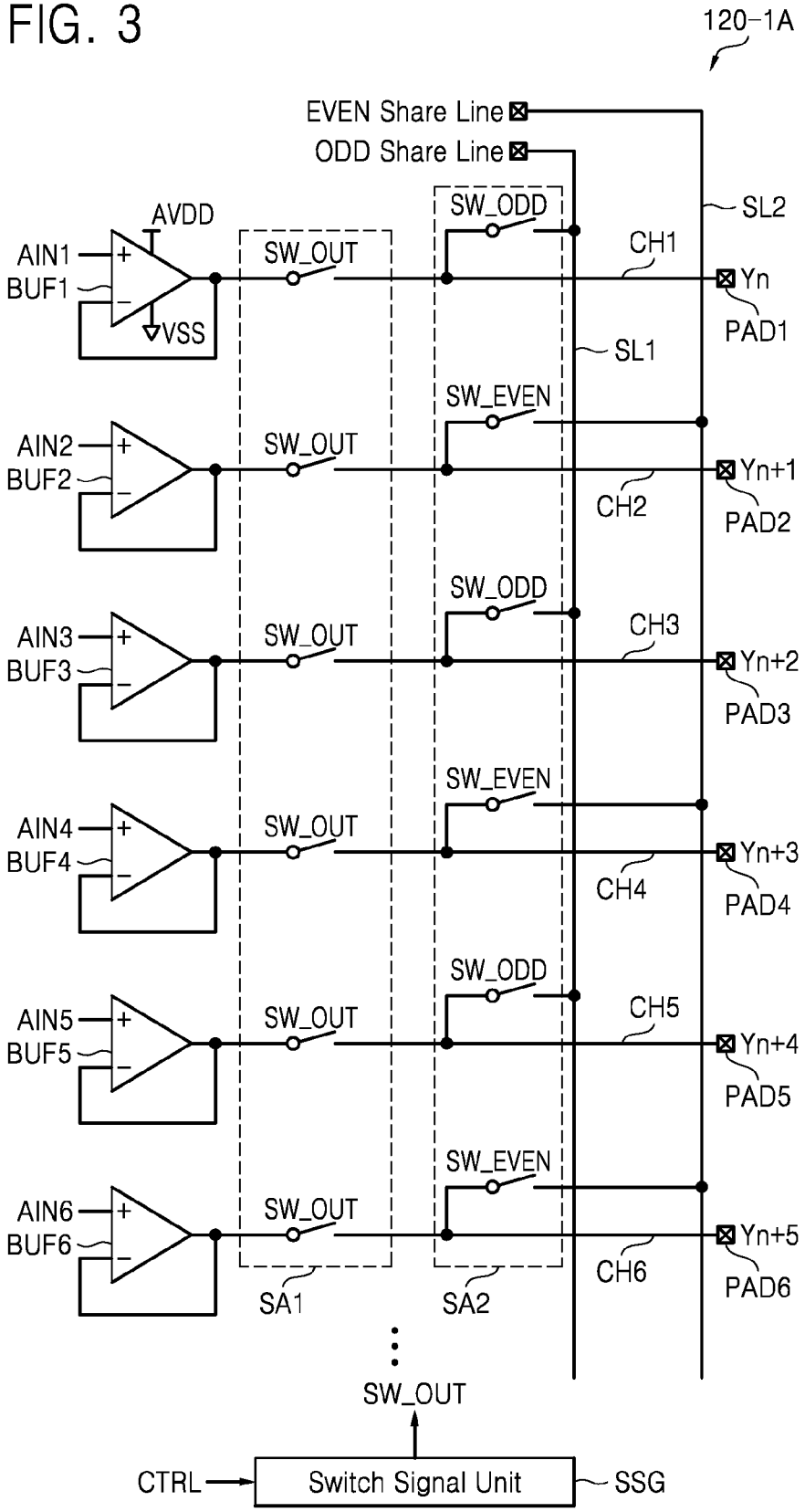
FIG. 3 is a block diagram of an exemplary channel buffer such as described in FIG. 1 or 2, according to one embodiment.
Figure 4:
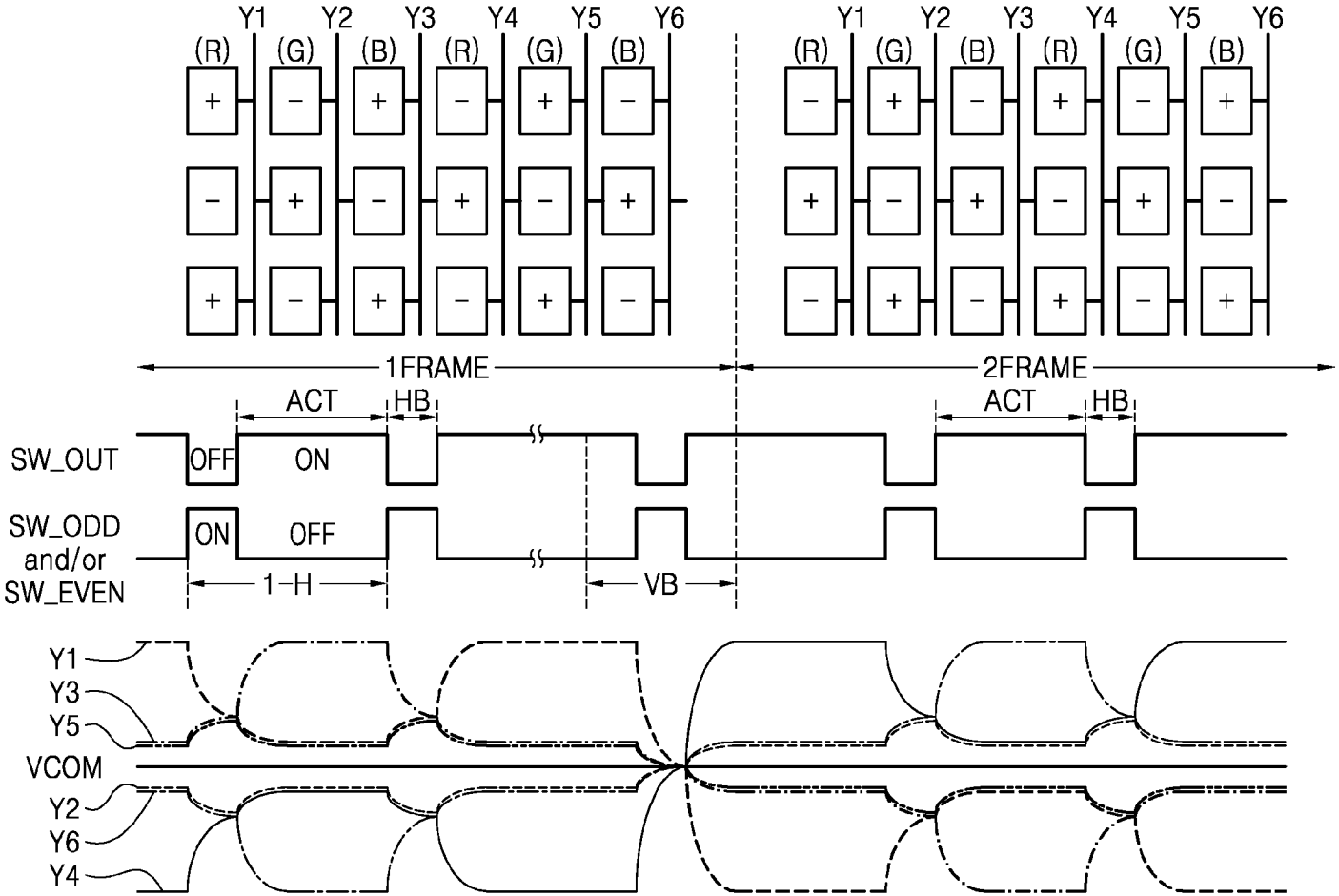
FIG. 4 is a conceptual diagram for describing an exemplary column inversion-charge sharing method performed by the display module in FIG. 1 or 2, according to one embodiment.

FIG. 3 illustrates an exemplary block diagram of the channel buffer in FIG. 1 or 2, and FIG. 4 is a conceptual diagram for describing a Z-inversion-charge sharing method performed by the display module in FIG. 1 or 2.

As described above, the switch signal generator 150A in FIG. 1 or the control circuit 151A in FIG. 2 generate the charge sharing switch signals SW_ODD and SW_EVEN.

A switch signal generation unit SSG included in the channel buffer 120-1A may generate a switch signal SW_OUT in response to a control signal CTRL. For example, the control signal CTRL may be generated based on at least one first control signal CTRL1.

For convenience of description in FIG. 3, an example embodiment in which the channel buffer 120-1A includes a switch signal generation unit SSG is illustrated; however, the switch signal generation unit SSG may be included in the switch signal generator 150A of FIG. 1 or in the control circuit 151A of FIG. 2.

The channel buffer 120-1A includes a plurality of buffers BUF1 to BUF6, . . . , a first switch array SA1, a second switch array SA2, a first charge sharing line SL1, a second charge sharing line SL2, a plurality of source lines CH1 to CH6, and a plurality of output pads PAD1 to PAD6.

The plurality of buffers BUF1 to BUF6, . . . , buffer image signals AIN1 to AIN6, . . . output from the image data signal processing circuit 121. For convenience of description, an operation of the channel buffer 120-1A is described assuming that the number of the plurality of buffers BUF1 to BU6, . . . is 6. Each of the plurality of buffers BUF1 to BUF6 may be embodied, for example, in a unit gain buffer.

Odd numbered buffer BUF1, BUF3, and BUF5 among the plurality of buffers BUF1 to BUF6 buffer image signals AIN1, AIN3, and AIN5, having a same polarity respectively. Even numbered buffers BUF2, BUF4, and BUF6 buffer image signals AIN2, AIN4, and AIN6, having a same polarity respectively. In one embodiment, the polarity for the odd-numbered buffers is opposite the polarity for the even-numbered buffers. Also, in one embodiment, for each frame, the polarity of each set of odd or even numbered buffers changes from a first polarity to a second, opposite polarity, or from the second polarity to the first.

In the embodiment shown in FIGS. 3 and 4, each of the plurality of buffers BUF1 to BUF6 outputs a respective image signal AIN1 to AIN6 swinging between a first operation voltage AVDD and a ground voltage VSS.

For example, one of a first polarity (+) and a second polarity (−) in FIG. 4 denotes a voltage higher than a common voltage VCOM, and the other of the first polarity (+) and the second polarity (−) denotes a voltage lower than the common voltage VCOM. As shown in FIG. 4, in one embodiment a set of buffers connected to a first set of source lines (e.g., odd-numbered buffers) maintains a higher voltage than a common voltage VCOM during a first frame, wherein the voltage changes values based on data being input to the buffers. Similarly, a set of buffers connected to a second set of source lines (e.g., even-numbered buffers) maintains a lower voltage than a common voltage VCOM during the first frame, wherein the voltage changes values based on data being input to the buffers. During a subsequent frame, in one embodiment, the voltages applied to each set of source lines is inversed (e.g., voltages higher than the common voltage VCOM during the first frame are lower than the common voltage in the second frame, and vice versa).

A first switch array SA1 includes a plurality of first switches, and controls connection between each of the plurality of buffers BUF1 to BUF6 and each of the plurality of source lines CH1 to CH6 in response to a switch signal SW_OUT. The plurality of first switches may include a first group, such as those switches connected to odd pads PAD1, PAD3, AND PAD5, and a second group, such as those switches connected to even pads PAD2, PAD4, and PAD6.

For example, in an active interval ACT or an image display interval of each frame 1FRAME and 2FRAME, the switch signal SW_OUT is activated, and accordingly each of the plurality of first switches included in the first switch array SA1 connects each of the plurality of buffers BUF1 to BUF6 with each of the plurality of source lines CH1 to CH6.

However, in a charge sharing interval HB or VB, the switch signal SW_OUT is deactivated. Accordingly, each of the plurality of buffers BUF1 to BUF6 and each of the plurality of source lines CH1 to CH6 are separated (or disconnected) from each other.

For example, the charge sharing interval HB or VB may denote an interval between lines or an interval between frames.

The switch signal SW_OUT and each charge sharing switch signal SW_ODD and SW_EVEN may be complementary signals, at least during certain time periods. In certain embodiments, the charge sharing switch signals SW_ODD and SW_EVEN are selectively activated or not activated when the switch signal SW_OUT is deactivated, but are always deactivated when the switch signal SW_OUT is activated. For example, in one embodiment, each charge sharing switch signal SW_ODD and SW_EVEN may only be activated during a certain period (or interval) of time whenever a line or a frame is changed, though the signals do not need to be activated during those time periods. Here, '1-H' may denote one-line time in FIG. 4.

According to an example embodiment, the charge sharing interval HB or VB may denote a horizontal blank interval HB or a vertical blank interval VB. For example, the horizontal blank interval HB may denote time difference between one line and the next line, and the vertical blank interval VB may denote time difference between a last line of one frame and a first line of the next frame.

A second switch array SA2 includes a first switch group or set and a second switch group or set. The first switch group includes a plurality of first sub (or odd numbered)-switches.

In response to the first charge sharing switch signal SW_ODD, each of the plurality of first sub-switches controls connection between a first charge sharing line SL1 and each of the odd numbered source lines CH1, CH3, and CH5 among the plurality of source lines CH1 to CH6.

The second switch group includes a plurality of second sub (or even numbered)-switches.

In response to a second charge sharing switch signal SW_EVEN, each of the plurality of second sub-switches controls connection between a second charge sharing line SL2 and each of the even numbered source lines CH2, CH4, and CH6 among the plurality of source lines CH1 to CH6.

The first charge sharing line SL1 and the second charge sharing line SL2 are electrically separated from each other, respectively, and may be in a floating state. As such, in one embodiment, coupling between the first charge sharing line SL1 and the odd numbered source lines CH1, CH3, and CH5 is independent from the coupling between the second charge sharing line SL2 and the even numbered source lines CH2, CH4, and CH6.

A plurality of output pads PAD1 to PAD6 connected to the plurality of source lines CH1 to CH6 may be connected to a plurality of data lines of the display panel 110.

Each output signal Y1 to Y6 in FIG. 4 denotes an output signal Yn to Yn+5, where n is 1, of each output pad PAD1 to PAD6. Here, R denotes a red image signal, G is a green image signal, and B is a blue image signal.

In one embodiment, when a charge sharing operation is needed in a Z-inversion method, the first charge sharing switch signal SW_ODD is activated in every charge sharing interval HB and VB. Accordingly, the first charge sharing line SL1 and each of the odd numbered source lines CH1, CH3, and CH5 are connected with each other during those intervals.

Moreover, in this embodiment, when a charge sharing operation is needed in a Z-inversion method, the second charge sharing switch signal SW_EVEN is activated in every charge sharing interval HB and VB. Accordingly, the second charge sharing line SL2 and each of the even numbered source lines CH2, CH4, and CH6 are connected with each other during those intervals.

In another embodiment, however, the first charge sharing switch signal SW_ODD and the second charge sharing switch signal SW_EVEN are not necessarily activated in every interval HB and VB, but instead each are selectively controlled to be activated or deactivated according to one or more count values, such as described previously. Examples of this method will be described in greater detail below. The first charge sharing switch signal SW_ODD and the second charge sharing switch signal SW_EVEN may be activated simultaneously or at a different time. In addition, as described above and in more detail below, in certain embodiments, only one of the first charge sharing switch signal SW_ODD and the second charge sharing switch signal SW_EVEN, or neither signal, is activated in the charge sharing interval HB and VB. For example, whether either of the charge sharing switch signals is activated may depend on how much power can be saved by performing charge sharing, as described further below.

As shown in the example of FIG. 4, as a result of the Z-inversion, during each frame 1FRAME and 2FRAME, charge sharing occurs between source lines transmitting image signals having the same polarity for a particular row of data.

In this embodiment, a source line denotes a signal line transmitting an output signal of a buffer to an output pad. The source line may be referred to as a channel.

For convenience of description in FIG. 3, the word "output pad" is used as a connection means electrically connecting a source line of the source driver 120A or 120B with a data line of the display panel 110. However, the output pad is no more than exemplification. Accordingly, the output pad may have one or more known structures, a name and a structure of the connection means may be variously changed (e.g., terminal, output terminal, electrical connector, etc.).

Figure 5:
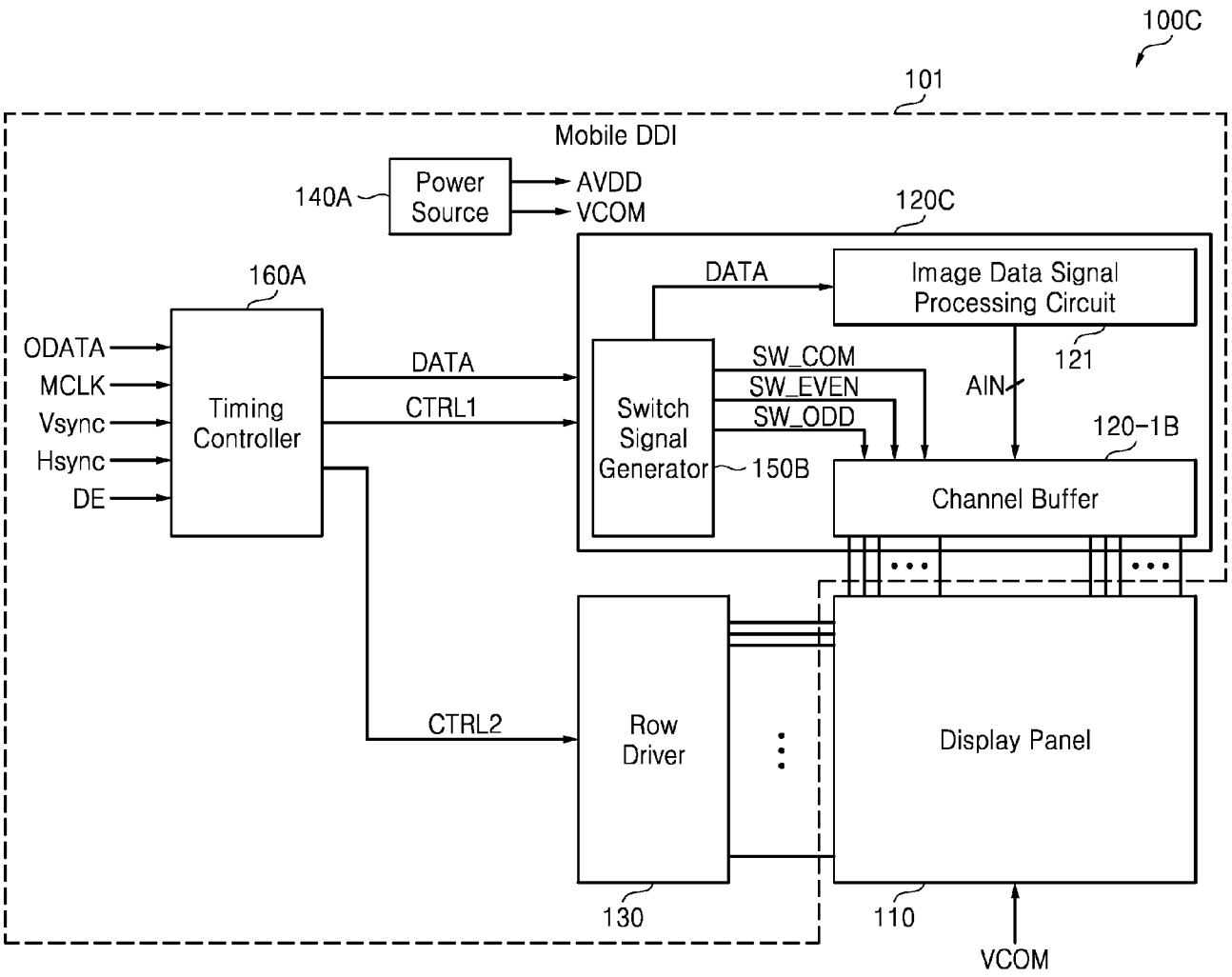
FIG. 5 is a block diagram illustrating an example embodiment of a display module which may perform a dot inversion-charge sharing method according to another example embodiment.

FIG. 5 is a block diagram depicting an example of a display module which may perform a dot inversion-charge sharing method according to one exemplary embodiment.

Except for a source driver 120C, a structure and an operation of the display module 100A in FIG. 1 are substantially the same as a structure and an operation of a display module 100C in FIG. 5.

The source driver 120C includes a channel buffer 120-1B, an image data signal processing circuit 121, and a switch signal generator 150B. The display module 100C in FIG. 5 may perform not only the Z-inversion-charge sharing method but also the dot inversion-charge sharing method, or a column inversion charge sharing method.

Similarly to an operation of the switch signal generator 150A in FIG. 1, in one embodiment, the switch signal generator 150B in FIG. 5 compares upper bits of each of image data signals included in a previous line of image data DATA with upper bits of each of image data signals included in a current line of the image data, counts the number of image data signals which do not accord with each other based on a result of the comparison, and outputs a count value.

The switch signal generator 150B may compare the count value with a reference value, and control whether to activate each of the charge sharing switch signals SW_ODD and SW_EVEN and whether to activate a first switch signal SW_COM based on a result of the comparison. The switch signal generator 150B may transmit image data DATA to the image data signal processing circuit 121.

The DDI 101 may include the source driver 120C, the row driver 130, the power source 140A, and the timing controller 160A.

Figure 6:
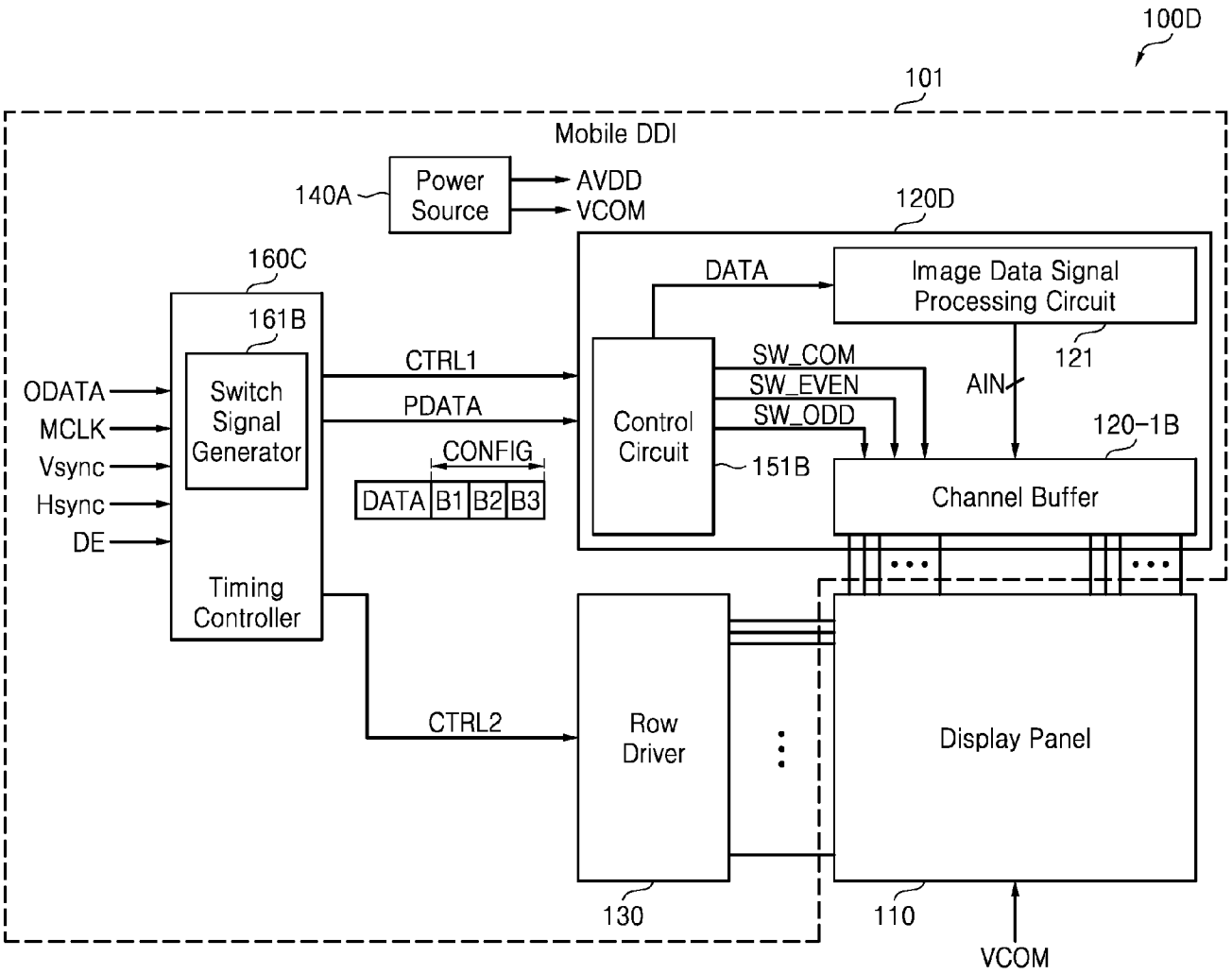
FIG. 6 is a block diagram illustrating another example embodiment of the display module which may perform a dot inversion-charge sharing method according to another example embodiment.

FIG. 6 is a block diagram illustrating another example of the display module which may perform a dot inversion-charge sharing method according to another exemplary embodiment.

Except for a source driver 120D and a timing controller 160C, a structure and an operation of the display module 100C in FIG. 5 are substantially the same as a structure and an operation of a display module 100D in FIG. 6.

The source driver 120D includes a channel buffer 120-1B, an image data signal processing circuit 121, and a control circuit 151B. The display module 100D in FIG. 6 may perform not only the Z-inversion-charge sharing method but also the dot inversion-charge sharing method.

In one embodiment, the switch signal generator 161B of the timing controller 160C compares upper bits of each of image data signals included in a previous line of original image data ODATA with upper bits of each of image data signals included in a current line of the original image data ODATA, counts the number of image data signals which do not accord with each other, and outputs a count value.

The switch signal generator 161B compares the count value with a reference value, and generates indication bits B1 to B3 based on a result of the comparison.

The timing controller 160C generates data packet PDATA including image data DATA and three indication bits B1 to B3. For example, the timing controller 160C may process original image data ODATA and generate image data DATA.

According to example embodiments, a transmission sequence of the image data and three indication bits B1 to B3 may be variously changed.

Three indication bits B1 to B3 may be included in a configuration field CONFIG of the data packet PDATA. Here, a first indication bit B1 indicates whether to activate the first charge sharing switch signal SW_ODD, a second indication bit B2 indicates whether to activate the second charge sharing switch signal SW_EVEN, and a third indication bit B3 indicates whether to activate a first switch signal SW_COM.

The control circuit 151B may interpret (or analyze) three indication bits B1 to B3 included in the data packet PDATA, and generate charge sharing switch signals SW_ODD and SW_EVEN and a first switch signal SW_COM based on a result of the interpretation. The control circuit 151B may transmit the image data DATA included in the data packet PDATA to the image data signal processing circuit 121.

The DDI 101 may include the source driver 120D, the row driver 130, the power source 140A, and the timing controller 160C.

Figure 7:
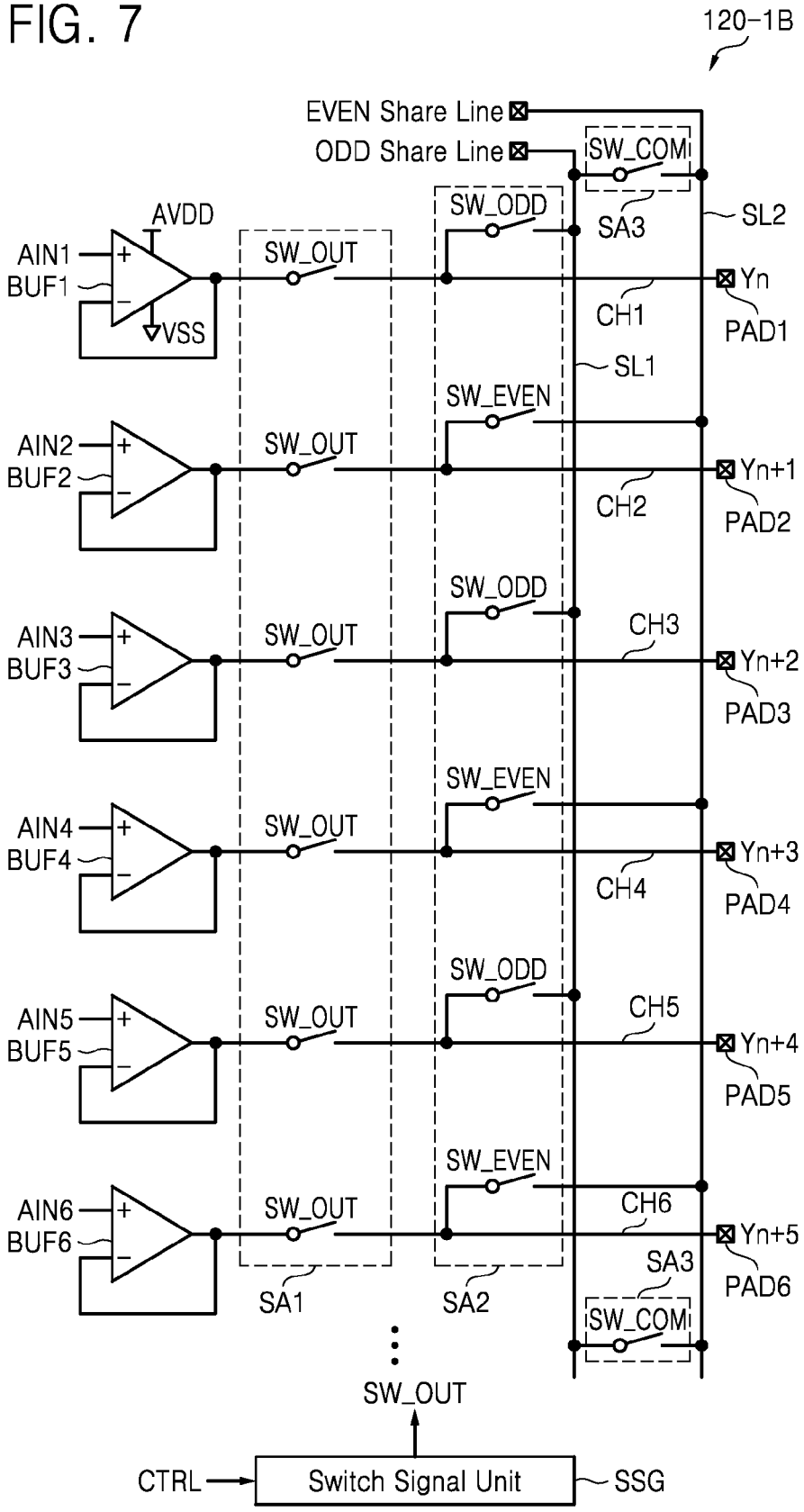
FIG. 7 is a block diagram of an exemplary channel buffer such as described in FIG. 5 or 6, according to one embodiment.
Figure 8:
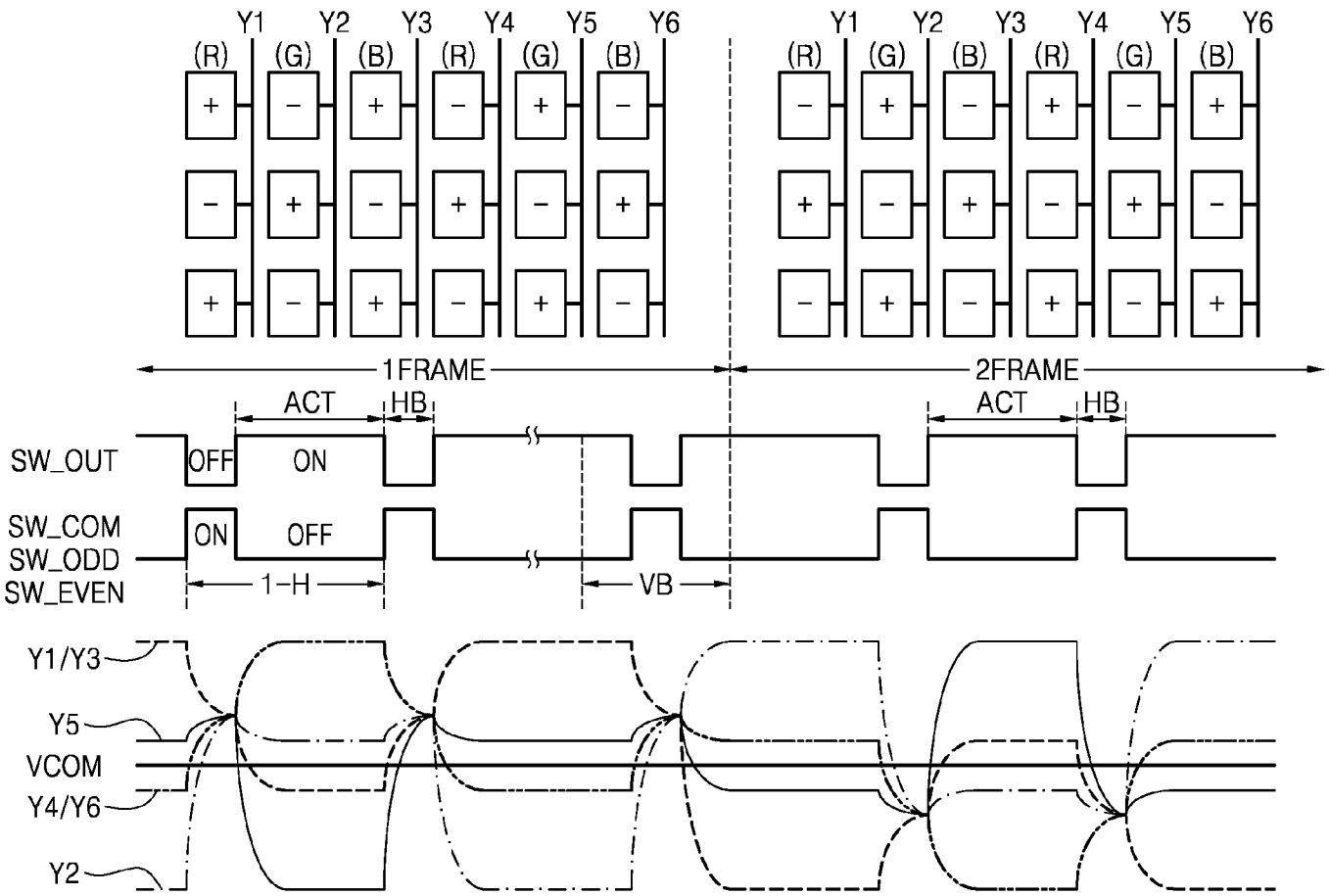
FIG. 8 is a conceptual diagram for describing an exemplary dot inversion-charge sharing method performed by the display module in FIG. 5 or 6, according to one embodiment.

FIG. 7 is a block diagram of the channel buffer in FIG. 5 or 6, and FIG. 8 is a conceptual diagram for describing the dot inversion-charge sharing method performed by the display module in FIG. 5 or 6.

Except for at least one third switch SA3, the channel buffer 120-1A in FIG. 3 has substantially the same structure and operation as the channel buffer 120-1B in FIG. 7.

As described above, the switch signal generator 150B in FIG. 5 or the control circuit 151B in FIG. 6 generates the charge sharing switch signals SW_ODD and SW_EVEN and the first switch signal SW_COM. A switch signal generation unit SSG included in the channel buffer 120-1B generates the switch signal SW_OUT in response to a control signal CTRL.

In response to the first switch signal SW_COM, at least one third switch SA3 electrically connects a first charge sharing line SL1 to a second charge sharing line SL2.

When a charge sharing operation is needed in the dot inversion method, each switch signal SW_ODD, SW_EVEN, and SW_COM is activated in each interval HB and VB where charge sharing occurs, and thereby a charge of each source line CH1 to CH6 for those intervals is shared with each other. A charge sharing level may be changed according to a pattern of the image data DATA (e.g., based on the comparisons explained above and described further below).

Figure 9:
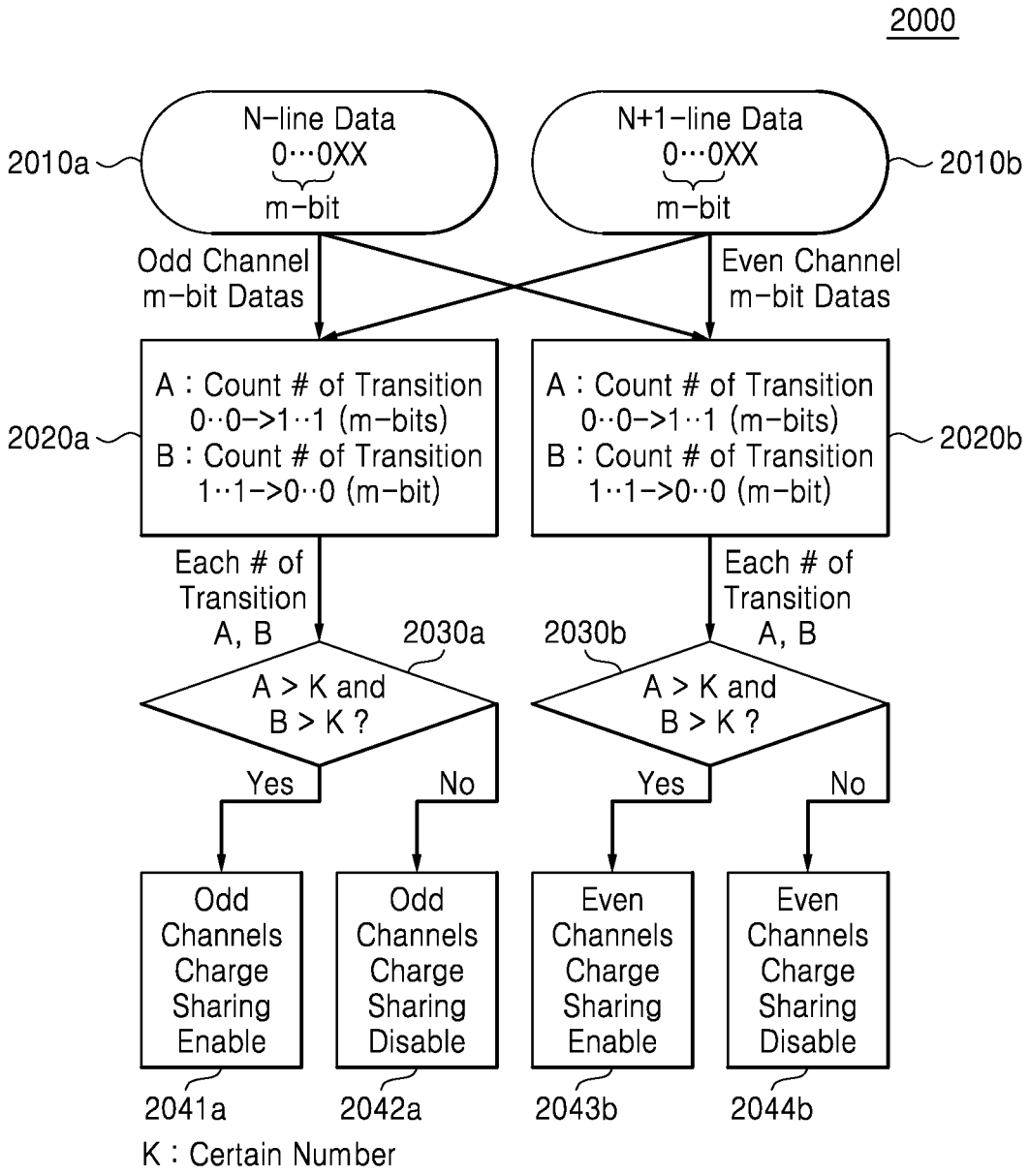
FIG. 9 is an block diagram illustrating an exemplary method for determining whether to perform charge sharing, according to one embodiment.

FIG. 9 shows an example of a method for determining whether to perform charge sharing among even channels and/or among odd channels based on certain count values. FIG. 9 will be described in connection with FIGS. 3 and 4 as an example.

Between any two consecutive received rows of image data (e.g., received at different data lines, or pixel rows), the data for each source line may change, or may remain the same. A change amount may be determined. For example, if both red and green data are to be at a maximum intensity value for two consecutive lines, data for source line Y1 may have the same value (and thus same voltage level) for both data lines. In this example, the change amount would be zero. A change amount may be compared to a threshold change amount to determine whether the change amount exceeds the threshold. Alternatively, whether a change amount exceeds a threshold may be determined in other ways. In the example above, since there will be no change, a number of change amounts that exceed a threshold will not increase as a result of source line Y1 between those consecutive data lines. However, if the data for source line Y1 does change, and the change amount is above a particular threshold amount (e.g., in one embodiment if a most significant bit for the data changes from a 1 to a 0 or from a 0 to a 1), then a number of change amounts above the threshold increases as a result of source line Y1 between those consecutive received rows of image data.

A similar determination may be made for the other source lines between the two consecutive rows of image data. In one embodiment, different counts may be determined for one type of data transition between consecutive data lines. For example, a first count may indicate a number of transitions where a signal level changes from low to high more than a threshold amount (e.g., when a most significant bit for the data changes from a 0 to a 1). A second count may indicate a number of transitions where a signal level changes from high to low more than a threshold amount (e.g., when a most significant bit for the data changes from a 1 to a 0).

As shown in FIG. 9, for example, in blocks 2010*a* and 2010*b*, an N-th row of data may include m-bits for each source line, and an N+1-th row of data may include m-bits for each source line. A first group of channels (e.g., odd channels) representing a first group of the source lines may be grouped together, and a second group of channels (e.g., even channels) representing a second group of the source lines may be grouped together. However, the odd and even arrangement is exemplary only, and other groupings, including the same number or a great number of groups, may be made.

As shown in blocks 2020*a* and 2020*b*, for each group of channels, a number of transitions from a first to a second state is determined (e.g., a number of first transitions for which a signal value changes more than a positive threshold amount—such as from a most significant bit of 0 to a most significant bit of 1), and a number of second transitions from the second to the first state is determined (e.g., a number of transitions for which a signal value changes more than a negative threshold amount—such as from a most significant bit of 1 to a most significant bit of 0). The first transitions may indicate a rise in voltage above a certain absolute value amount, and the second transitions may indicate a decrease in voltage above a certain absolute value amount. A count value for each of these types of transitions is determined. As an example, if three source lines of the first group of channels are to transition from the first state to the second state between the two consecutive rows of data, then the count number of transitions, as shown in FIG. 9, would have a value of A. If three source lines of the first group of channels are to transition from the second state to the first state between the two rows of data, then the count number of transitions, as shown in FIG. 9, would have a value of B. Though examples of three for the values of A and B are described above, these are exemplary only.

As shown in decision blocks 2030*a* and 2030*b*, in one embodiment, each of the transition count values A and B are compared to a reference amount (e.g., K). If both A and B are above the reference amount K, then charge sharing between the two data lines may be enabled (blocks 2041*a* and 2043*b*). If one of A or B are below the reference amount K, then charge sharing is disabled (blocks 2042*a* and 2044*b*).

A value of K can be set based on design requirements or other factors, and may be a predetermined value or percentage. For example, each reference amount K may be set as a percentage of total channels in the group, or a percentage of total channels in the display driver. For example, if a group of channels (e.g., odd channels) includes X channels, the amount K can be set to be X/3, X/4, X/5, or some other amount. Furthermore, the reference amount can have a different value for different groups of channels.

In one embodiment, the data for two consecutive rows is stored in a buffer before being sent to the source lines, and in this manner, whether the number of transitions of each type is above a reference amount may be determined in advance of the second row of data, and charge sharing during the interval between the two consecutive rows being sent to the source lines can be carried out based on the determination.

When complementary data transitions are dominant within a group of channels (e.g., as the transition count values A and B increase together for each channel group) charge sharing becomes more effective to save power. Therefore, by selectively determining when to implement charge sharing, as described in the examples above, power savings can be increased.

Figure 10:
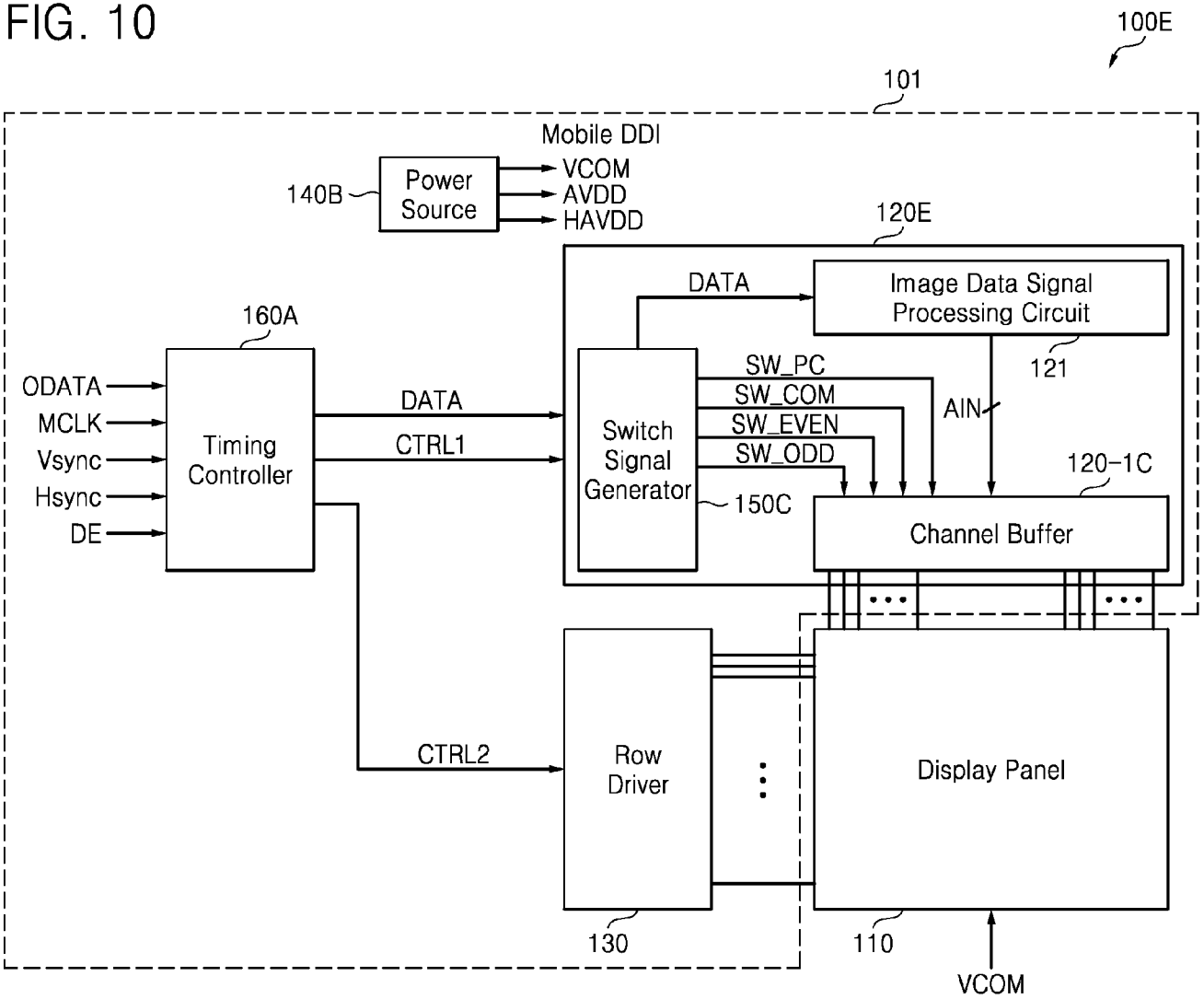
FIG. 10 is a block diagram illustrating an example embodiment of a display module which may perform a dot inversion-precharge method according to still another example embodiment.

FIG. 10 is a block diagram illustrating an example embodiment of the display module which may perform a dot inversion-precharge method according to still another example embodiment.

Except for a source driver 120E and a power source 140B, a structure and an operation of the display module 100A in FIG. 1 are substantially the same as a structure and an operation of a display module 100E in FIG. 10.

The source driver 120E includes the channel buffer 120-1C, the image data signal processing circuit 121, and a switch signal generator 150C.

Similarly to the exemplary operation of the switch signal generator 150A discussed in connection with FIG. 1, the switch signal generator 150C in FIG. 10 compares upper bits of each of image data signals included in a previous line of image data DATA with upper bits of each of image data signals included in a current line of the image data, counts the number of image data signals which do not accord with each other, and outputs a count value.

The switch signal generator 150C may compare the count value with a reference value, and control whether to activate each of the charge sharing switch signals SW_ODD and SW_EVEN, whether to activate the first switch signal SW_COM, and whether to activate a second switch signal SW_PC based on a result of the comparison.

The power source 140B generates a first operation voltage AVDD, a second operation voltage HAVDD, and a common voltage VCOM. The first operation voltage AVDD and the second operation voltage HAVDD are supplied to the source driver 120E. The switch signal generator 150C transmits image data DATA to the image data signal processing circuit 121.

The DDI 101 includes the source driver 120E, the row driver 130, the power source 140B, and the timing controller 160A.

Figure 11:
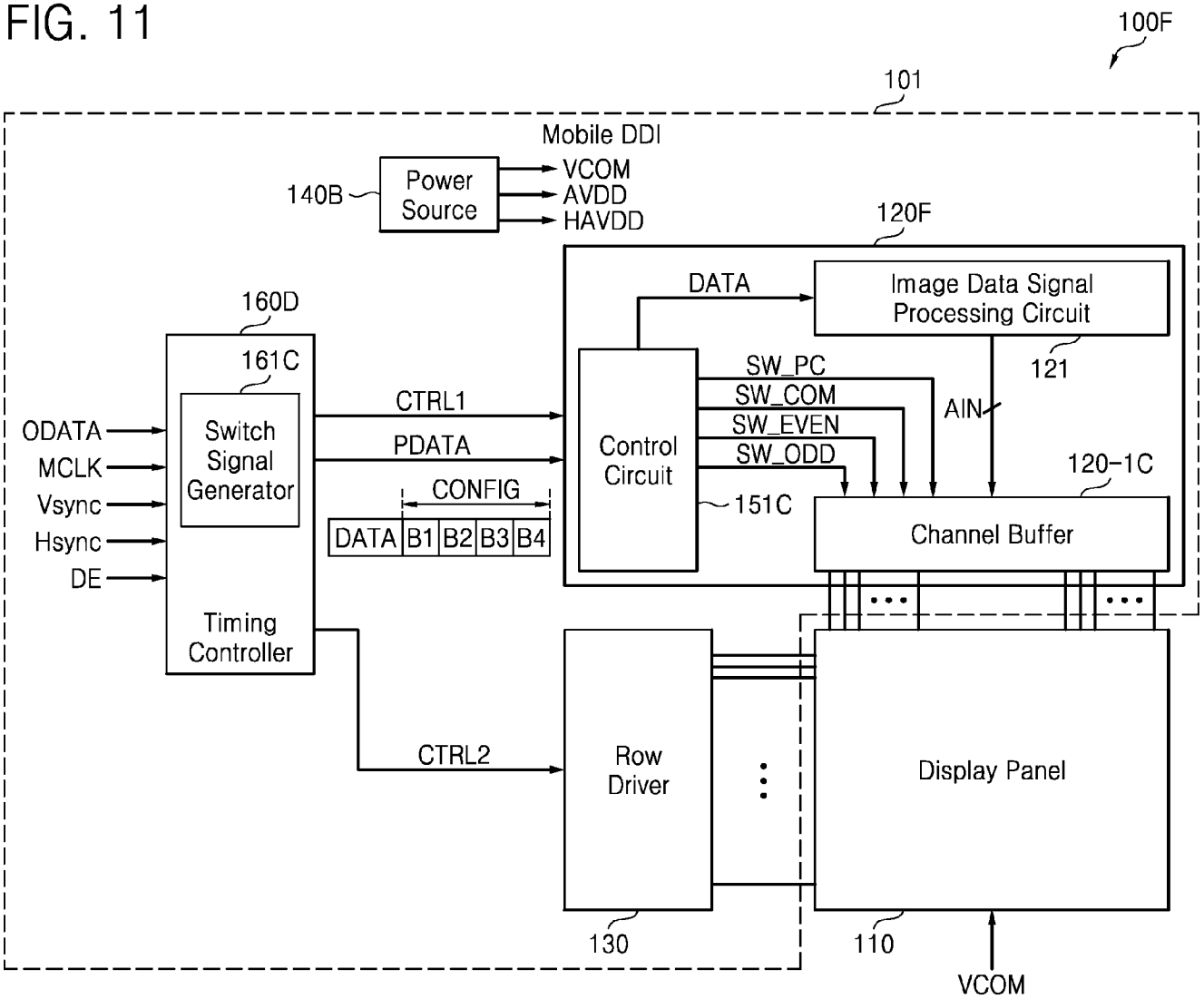
FIG. 11 is a block diagram illustrating another example embodiment of the display module which may perform a dot inversion-precharge method according to still another example embodiment.

FIG. 11 is a block diagram illustrating another example embodiment of the display module which may perform the dot inversion-precharge method according to still another example embodiment.

Except for a source driver 120F and a timing controller 160D, a structure and an operation of the display module 100E in FIG. 10 may be substantially the same as a structure and an operation of a display module 100F in FIG. 11.

The switch signal generator 161C of the timing controller 160D compares upper bits of each of image data signals included in a previous line of original image data ODATA with upper bits of each of image data signals included in a current line of the original image data ODATA, counts the number of image data signals which do not accord with each other, and outputs a count value.

The switch signal generator 161C compares the count value with a reference value, and generates indication bits B1 to B4 based on a result of the comparison. The timing controller 160D generates a data packet PDATA including image data DATA and four indication bits B1 to B4. According to example embodiments, a transmission sequence of the image data DATA and the four indication bits B1 to B4 may be variously changed.

The four indication bits B1 to B4 may be included in a configuration field CONFIG of the data packet PDATA. In one embodiment, a first indication bit B1 indicates whether to activate the first charge sharing switch signal SW_ODD, a second indication bit B2 indicates whether to activate the second charge sharing switch signal SW_EVEN, a third indication bit B3 indicates whether to activate the first switch signal SW_COM, and a fourth indication bit B4 indicates whether to activate the second switch signal SW_PC.

The control circuit 151C may interpret (or analyze) the four indication bits B1 to B4 included in the data packet PDATA, and generate the charge sharing switch signals SW_ODD and SW_EVEN, the first switch signal SW_COM, and the second switch signal SW_PC based on a result of the interpretation. The control circuit 151C transmits the image data DATA included in the data packet PDATA to the image data signal processing circuit 121.

The DDI 101 includes a source driver 120F, the row driver 130, the power source 140B, and the timing controller 160D.

Figure 12:
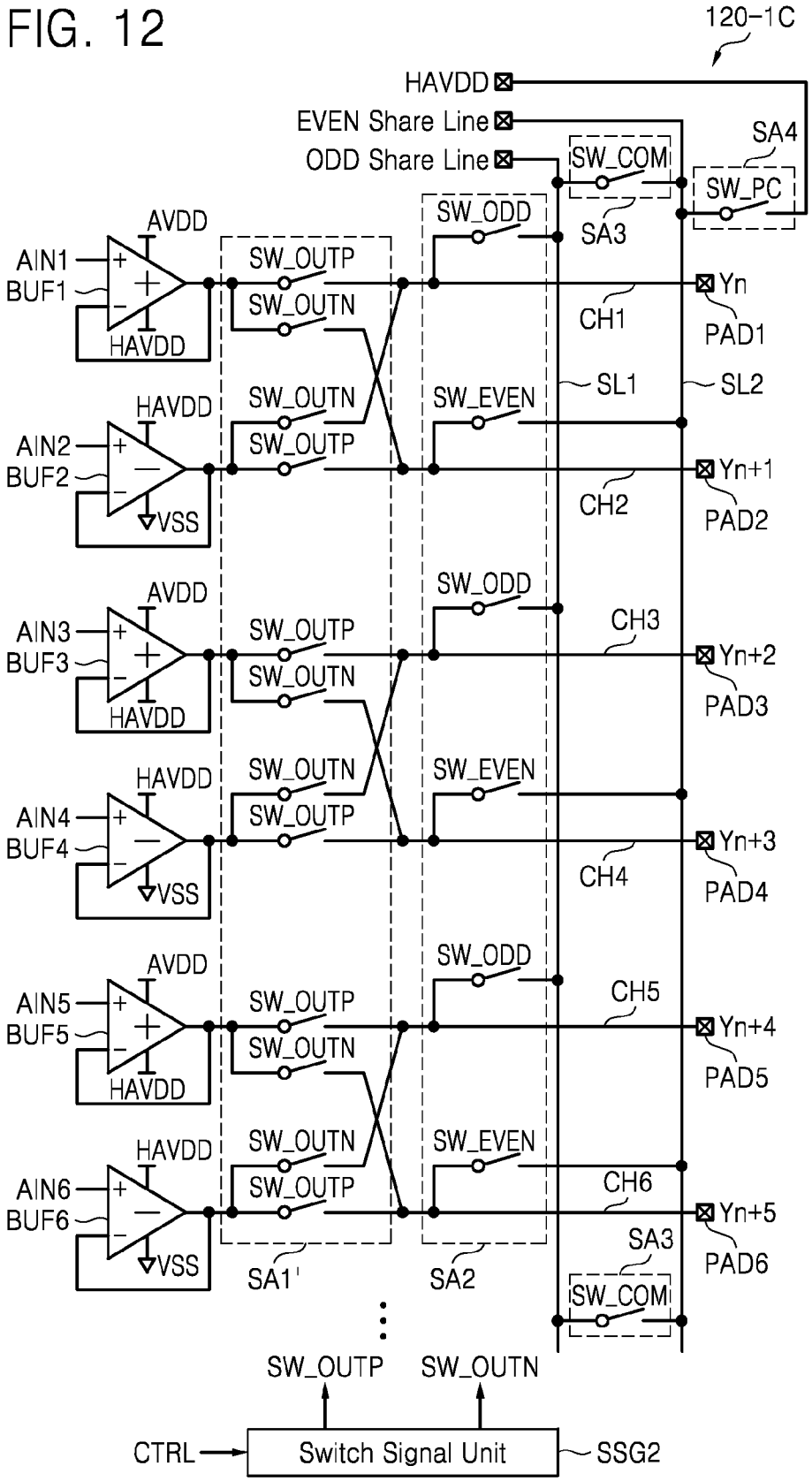
FIG. 12 is a block diagram of an exemplary channel buffer such as described in FIG. 10 or 11, according to one exemplary embodiment.
Figure 13:
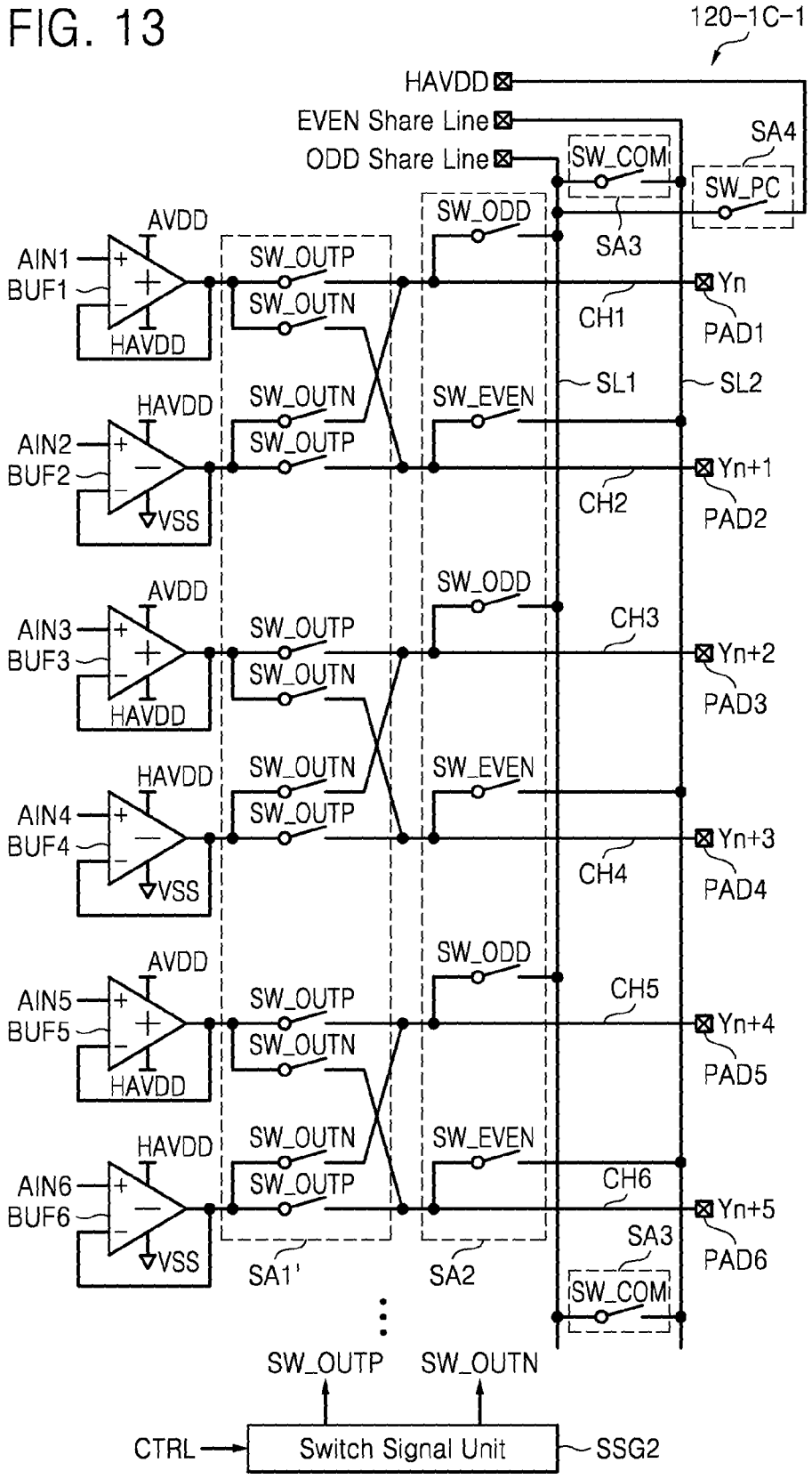
FIG. 13 is another block diagram of an exemplary channel buffer such as described in FIG. 10 or 11.
Figure 14:
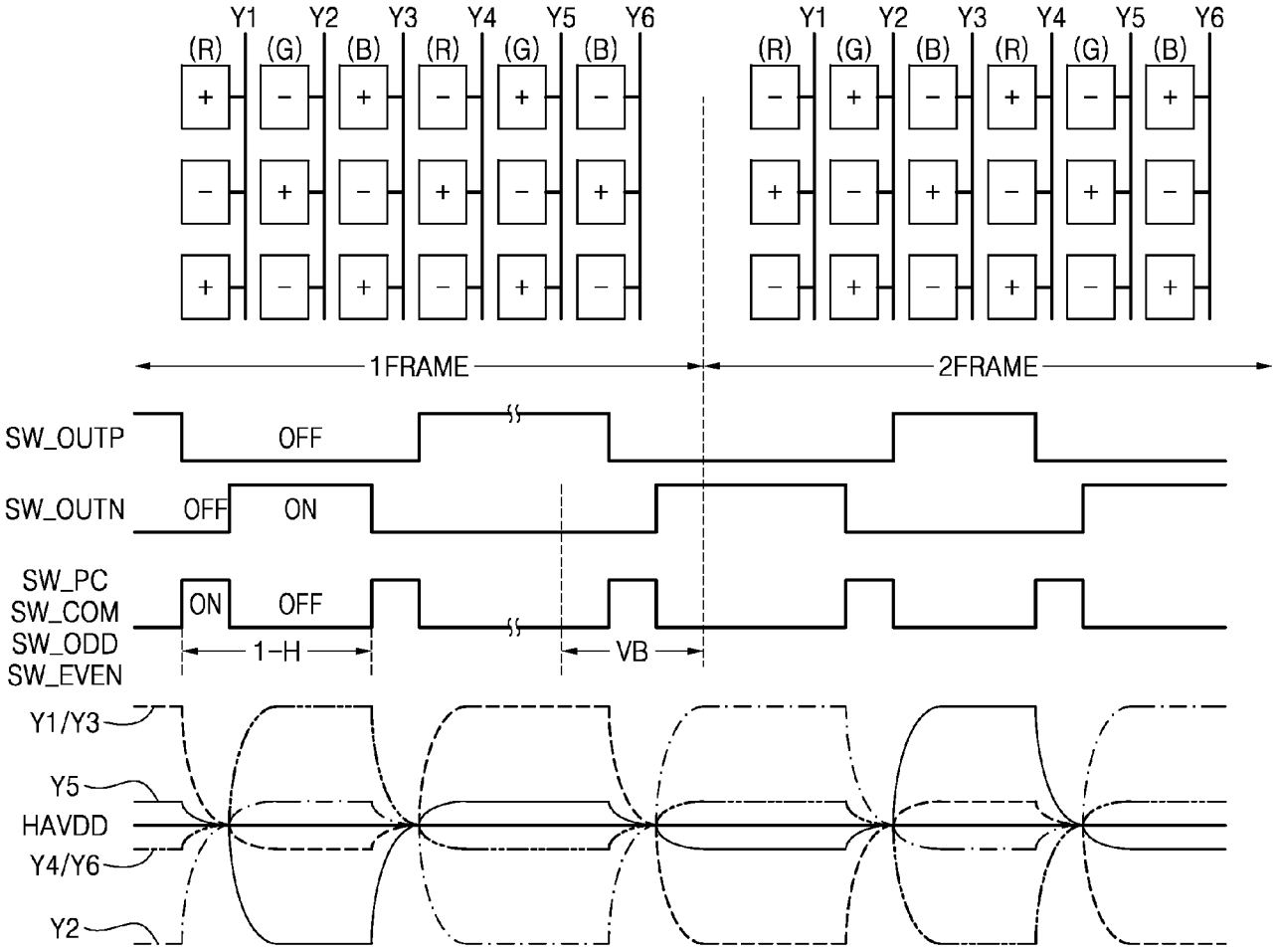
FIG. 14 is a conceptual diagram for describing a dot inversion-precharge method performed by the display module in FIG. 10 or 11, according to one exemplary embodiment.

FIG. 12 is a block diagram of a channel buffer in FIG. 10 or 11, FIG. 13 is another block diagram of the channel buffer in FIG. 10 or 11, and FIG. 14 is a conceptual diagram for describing the dot inversion-precharge method performed by the display module in FIG. 10 or 11.

As described above, the switch signal generator 150C in FIG. 10 or the control circuit 151C in FIG. 11 generates the charge sharing switch signals SW_ODD and SW_EVEN, the first switch signal SW_COM, and the second switch signal SW_PC.

A switch signal generation unit SSG2 included in the source driver 120-1C generates switch signals SW_OUTP and SW_OUTN in response to a control signal CTRL.

Except for voltage inputs, a first switch array SA1', and a fourth switch SA4, the channel buffer 120-1B in FIG. 7 and the channel buffer 120-1C in FIG. 12 are substantially the same, and the channel buffer 120-1B in FIG. 7 and a channel buffer 120-1C-1 in FIG. 13 are substantially the same.

Each of the odd numbered buffers BUF1, BUF3, and BUF5 among the buffers BUF1 to BUF6 outputs a signal swinging between the first operation voltage AVDD and the second operation voltage HAVDD. Each of the even numbered buffers BUF2, BUF4, and BUF6 among the buffers BUF1 to BUF6 outputs a signal swinging between the second operation voltage HAVDD and a ground voltage VSS.

For example, the second operation voltage HAVDD may be a half of the first operation voltage AVDD. For example, a level of the common voltage VCOM may be the same as a level of the second operation voltage HAVDD.

The first switch array SA1' may include a plurality of switches, and transmit an output signal of each odd numbered buffer BUF1, BUF3, and BUF5 to each odd numbered source line CH1, CH3, and CH5 or to each even numbered source line CH2, CH4, and CH6 in response to each switch signal SW_OUTP and SW_OUTN.

In addition, the first switch array SA1' may transmit an output signal of each even numbered buffer BUF2, BUF4, and BUF6 to each odd numbered source line CH1, CH3, and CH5, or to each even numbered source line CH2, CH4, and CH6.

The fourth switch SA4 supplies a precharge voltage, i.e., the second operation voltage HAVDD to at least one of the first charge sharing line SL1 and the second charge sharing line SL2 in response to the second switch signal SW_PC.

As illustrated in FIG. 14, each switch signal SW_ODD, SW_EVEN, SW_COM, and SW_PC may be simultaneously activated, and thereby a charge of each source CH1 to CH6 is shared with each other.

For example, when each source line CH1 to CH6 is precharged with the second operation voltage, i.e., the precharge voltage HAVDD, before an output signal of each buffer BUF1 to BUF6 is changed in polarity, a voltage higher than the second operation voltage HAVDD may be prevented from being supplied to a transistor included in each buffer BUF1 to BUF6 as an internal voltage.

The fourth switch SA4 supplies the pre-charge voltage HAVDD to the second charge sharing line SL2 as illustrated in FIG. 12, and the fourth switch SA4 supplies the pre-charge voltage HAVDD to the first charge sharing line SL1 as illustrated in FIG. 13. As illustrated in FIG. 14, each switch signal SW_ODD, SW_EVEN, SW_COM, and SW_PC may be simultaneously activated.

Figure 15:
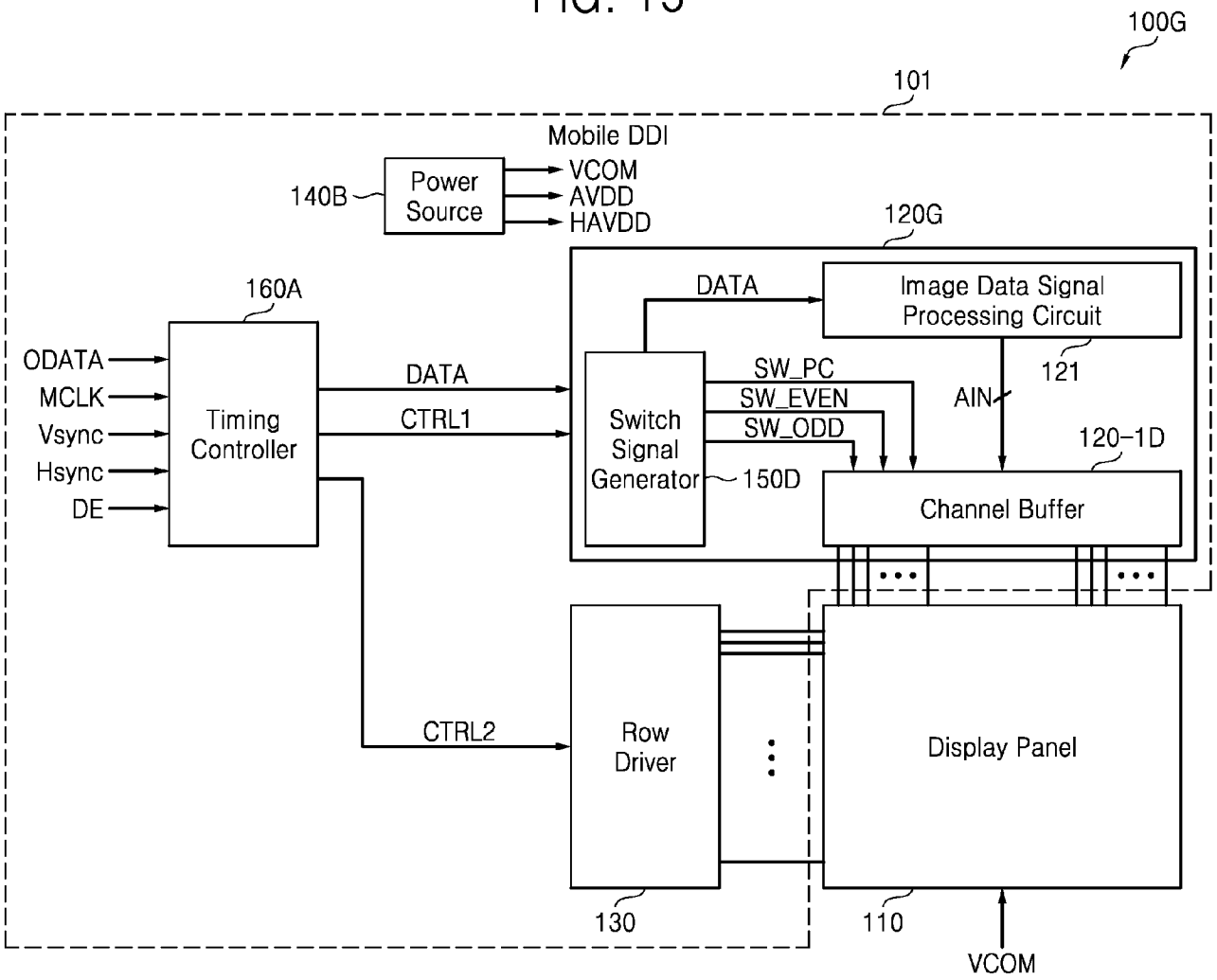
FIG. 15 is a block diagram illustrating an example embodiment of a display module which may perform a column inversion-precharge method according to still another example embodiment.

FIG. 15 is a block diagram illustrating an example embodiment of the display module which may perform a column inversion-precharge method according to still another example embodiment.

Except for a source driver 120G, a structure and an operation of the display module 100E in FIG. 10 are substantially the same as a structure and an operation of a display module 100G in FIG. 15.

The source driver 120G includes a channel buffer 120-1D, the image data signal processing circuit 121, and a switch signal generator 150D.

Similarly to an operation of the switch signal generator 150C in FIG. 10, the switch signal generator 150D in FIG. 15 compares upper bits of each of image data included in a previous line of image data DATA with upper bits of each of image data signals included in a current line of the image data, counts the number of image data signals which do not accord with each other, and outputs the count value.

The switch signal generator 150D compares the count value with a reference value, and controls whether to activate each of the charge sharing switch signals SW_ODD and SW_EVEN, and whether to activate the second switch signal SW_PC according to a result of the comparison. The switch signal generator 150D transmits image data DATA to the image data signal processing circuit 121.

The DDI 101 includes the source driver 120G, the row driver 130, the power source 140B, and the timing controller 160A.

Figure 16:
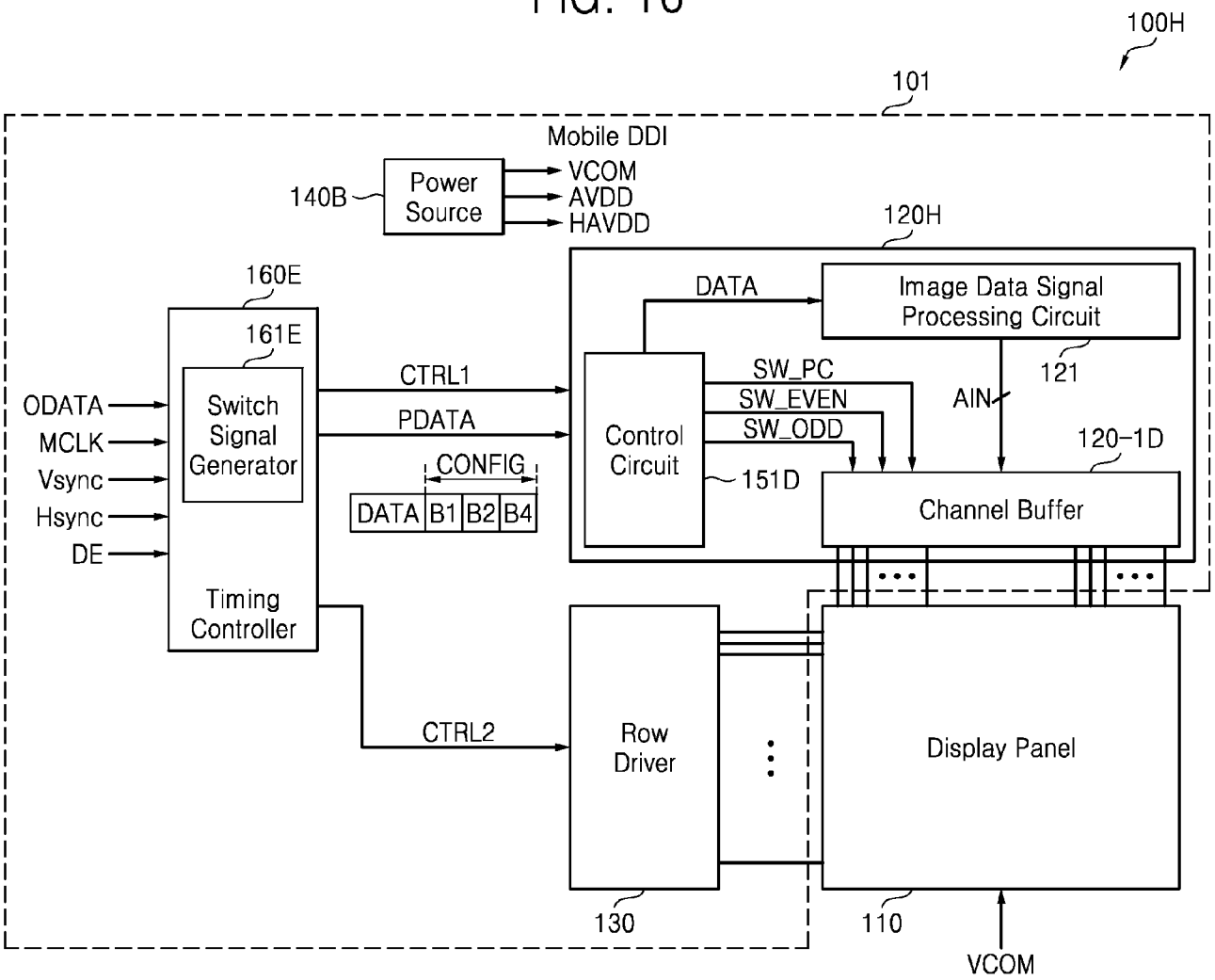
FIG. 16 is a block diagram illustrating another example embodiment of a display module which may perform a column inversion-precharge method according to still another example embodiment.

FIG. 16 is a block diagram depicting another example embodiment of the display module which may perform a column inversion-precharge method according to still another example embodiment of the present inventive concepts.

Except for a source driver 120H and a timing controller 160E, a structure and an operation of the display module 100G in FIG. 15 are substantially the same as a structure and an operation of a display module 100H in FIG. 16.

A switch signal generator 161E of the timing controller 160E compares upper bits of each of image data signals included in a previous line of original image data ODATA with upper bits of each of image data signals included in a current line of the original image data ODATA, counts the number of image data signals which do not accord with each other, and outputs the count value.

The switch signal generator 161E compares the count value with a reference value, and generates indication bits B1, B2, and B4 based on a result of the comparison. The timing controller 160E generates a data packet PDATA including image data DATA and three indication bits B1, B2, and B4.

According to example embodiments, a transmission sequence of the image data DATA and three indication bits B1, B2, and B4 may be variously changed. Three indication bits B1, B2, and B4 may be included in a configuration field CONFIG of the data packet PDATA.

In one embodiment, a first indication bit B1 indicates whether to activate the first charge sharing switch signal SW_ODD, a second indication bit B2 indicates whether to activate the second charge sharing switch signal SW_EVEN, and a third indication bit B4 indicates whether to activate the second switch signal SW_PC.

The control circuit 151D interprets (or analyze) three indication bits B1, B2, and B4 included in the data packet PDATA, and generates the charge sharing switch signals SW_ODD and SW_EVEN and the second switch signal SW_PC according to a result of the interpretation. The control circuit 151D transmits the image data DATA included in the data packet PDATA to the image data signal processing circuit 121.

The DDI 101 includes the source driver 120H, the row driver 130, the power source 140B, and the timing controller 160E.

Figure 17:
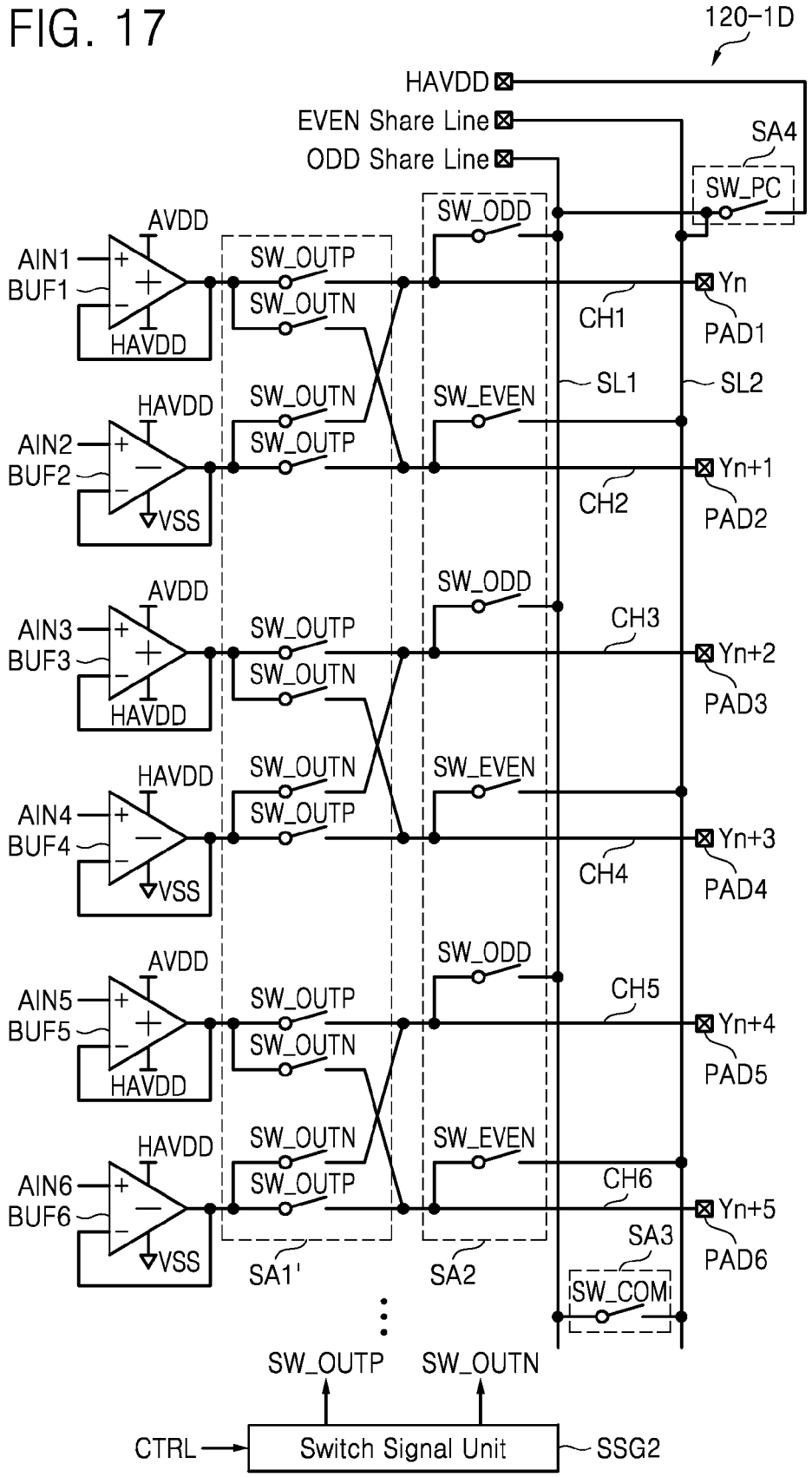
FIG. 17 is another block diagram of an exemplary channel buffer such as described in FIG. 15 or 16, according to one exemplary embodiment.

FIG. 17 is another block diagram of the channel buffer in FIG. 15 or 16. Except for the third switch SA3 removed and a connection relation of the fourth switch SA4, a structure and an operation of the channel buffer 120-1C in FIG. 12 are substantially the same as a structure and a operation of a channel buffer 120-1D in FIG. 17. Referring to FIG. 17, the fourth switch SA4 supplies the pre-charge voltage HAVDD to the first charge sharing line SL1 and the second charge sharing line SL2 in response to the second switch signal SW_PC.

Figure 18:
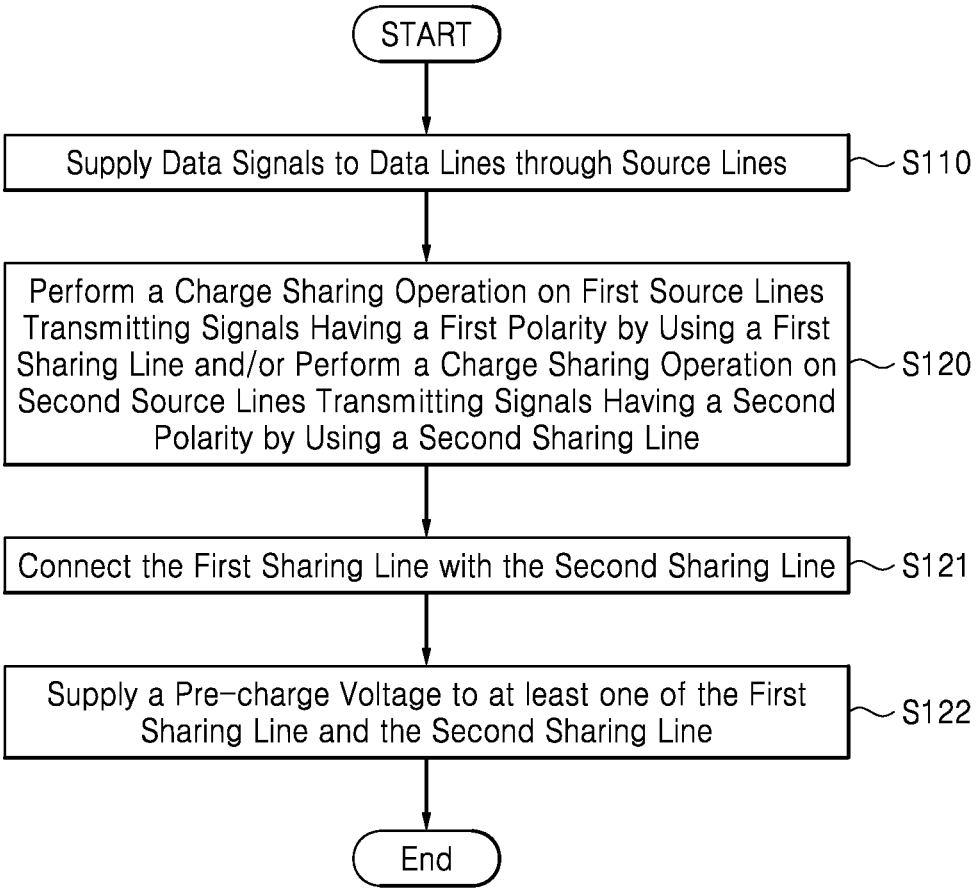
FIG. 18 is a flowchart for describing an exemplary operation of a source driver according to one or more of the example embodiments described herein.

FIG. 18 is a flowchart for describing an operation of a source driver according to certain example embodiments.

Referring to FIGS. 1 to 18, when a switch signal SW_OUT or SW_OUTP is activated, some buffers BUF1, BUF3, and BUF5 of the plurality of buffers BUF1 to BUF6 supply image signals having a first polarity to each of the odd numbered source lines CH1, CH3, and CH5, and the other buffers BUF2, BUF4, and BUF 6 of the plurality of buffers BUF1 to BUF6 supply image signals having a second polarity to each of the even numbered source lines CH2, CH4, and CH6 (S110). These polarities may be supplied during a first frame of data, and the polarities applied to each source line may be reversed in a second frame.

As described referring to FIGS. 1 to 4, when a charge sharing operation is used in a Z-inversion method, the plurality of buffers BUF1 to BUF6 and the plurality of source lines CH1 to CH6 are separated from each other, the first charge sharing line SL1 and the first source lines CH1, CH3, and CH5 are connected with each other, and the second charge sharing line SL2 and each of the second source lines CH2, CH4, and CH6 are connected with each other in charge sharing interval HB or VB (S120).

As such, a sharing operation is performed on first source lines transmitting image signals having a first polarity by using the first charge sharing line SL1, and a sharing operation is performed on second source lines transmitting image signals having a second polarity by using the second charge sharing line SL2 (S120).

As described referring to FIGS. 5 to 8, when a charge sharing operation is used in the dot inversion method, at least one third switch SA3 connects the first charge sharing line SL1 connected to the first source lines CH1, CH3, and CH5 with the second charge sharing line SL2 connected to the second source lines CH2, CH4, and CH6 to each other in each charge sharing interval HB or VB (S121).

As described referring to FIGS. 10 to 14, when a pre-charge operation is needed in the dot inversion method, the fourth switch SA4 supplies the pre-charge voltage HAVDD to at least one of the first charge sharing line SL1 and the second charge sharing line SL2 in each charge sharing interval HB or VB (S122).

Figure 19:
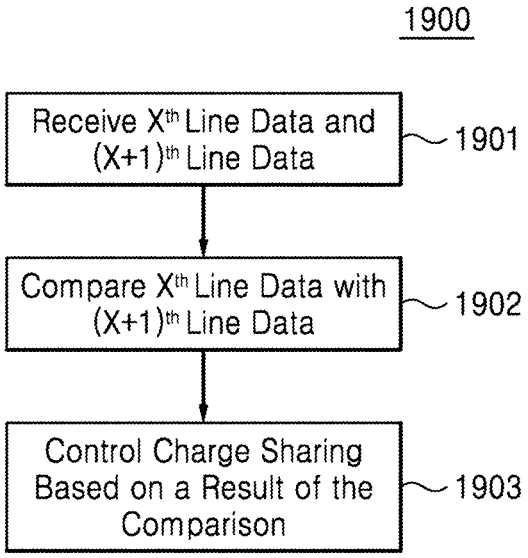
FIG. 19 is a flowchart for describing a method of generating a plurality of charge sharing switch signals according to an example embodiment.
Figure 20:
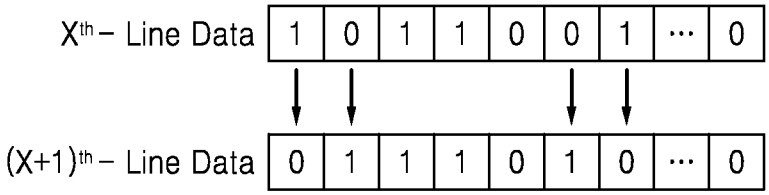
FIG. 20 is a conceptual diagram for describing an operation of a charge sharing switch signal generator according to an example embodiment.

FIG. 19 is a flowchart for describing a method of generating a plurality of charge sharing switch signals according to an example embodiment, and FIG. 20 is a conceptual diagram for describing an operation of a charge sharing switch signal generator according to example embodiments.

Switching signals SW_ODD, SW_EVEN, SW_COM, or SW_PC used for a charge sharing operation according to each inversion method may be generated inside the source driver 120A, 120C, 120E or 120G, or generated by the timing controller 160B, 160C, 160D or 160E. Whether to activate each of the switching signals SW_ODD, SW_EVEN, SW_COM, or SW_PC may be determined based on a change amount between image data signals in a previous line and image data signals in a current line.

In FIG. 20, each MSB of image data signals included in line data of a X-$^{th}$ line and each MSB of image data signals included in line data of a (X+1)-$^{th}$ line are illustrated. However, this is only an exemplary illustration. Referring to FIGS. 19 and 20, a switch signal generator 150A, 150B, 150C, or 150D compares each MSB of the image data signals included in the X-$^{th}$ line of the image data DATA with each MSB of the image data signals included in the (X+1)-$^{th}$ line of the image data DATA, counts the number of MSB changes, and outputs the count value (S210).

The switch signal generator 150A compares the count value with a reference value, and controls whether to activate each of the charge sharing switch signals SW_ODD and SW_EVEN according to a result of the comparison (S220).

For example, the switch signal generator 161A, such as described in FIG. 2 may generate indication bits B1 and B2 indicating whether to activate each of the charge sharing switch signals SW_ODD and SW_EVEN based on a result of the comparison. The indication bits B1 and B2 are decoded by the control circuit 151A.

The switch signal generator 150B compares the count value with a reference value, and controls whether to activate each of the charge sharing switching signals SW_ODD and SW_EVEN and whether to activate the first switch signal SW_COM based on a result of the comparison.

As another example, the switch signal generator 161B, such as described in FIG. 6 may generates indication bits B1 to B3 which may control whether to activate each of the charge sharing switch signals SW_ODD and SW_EVEN and whether to activate the first switch signal SW_COM based on a result of the comparison. The indication bits B1 to B3 are decoded by the control circuit 151B.

As another example, the switch signal generator 150C in FIG. 10 may compare the count value with a reference value, and control whether to activate each of the charge sharing switching signals SW_ODD and SW_EVEN, whether to activate the first switch signal SW_COM, and whether to activate the second switch signal SW_PC based on a result of the comparison.

As another example, the switch signal generator 161C in FIG. 11 may generate indication bits B1 to B4 which may control whether to activate each of the charge sharing switch signals SW_ODD and SW_EVEN, whether to activate the first switch signal SW_COM, and whether to activate the second switch signal SW_PC based on a result of the comparison. The indication bits B1 to B4 are decoded by the control circuit 151C.

As yet another example, the switch signal generator 150D in FIG. 15 may compare the count value with a reference value, and control whether to activate each of the charge sharing switching signals SW_ODD and SW_EVEN and whether to activate the second switch signal SW_PC based on a result of the comparison (S220).

As yet a further example, the switch signal generator 161E in FIG. 16 may generate indication bits B1, B2, and B4 which may control whether to activate each of the charge sharing switch signals SW_ODD and SW_EVEN and whether to activate the second switch signal SW_PC based on a result of the comparison. Indication bits B1, B2, and B4 are decoded by the control circuit 151D.

Figure 21A:
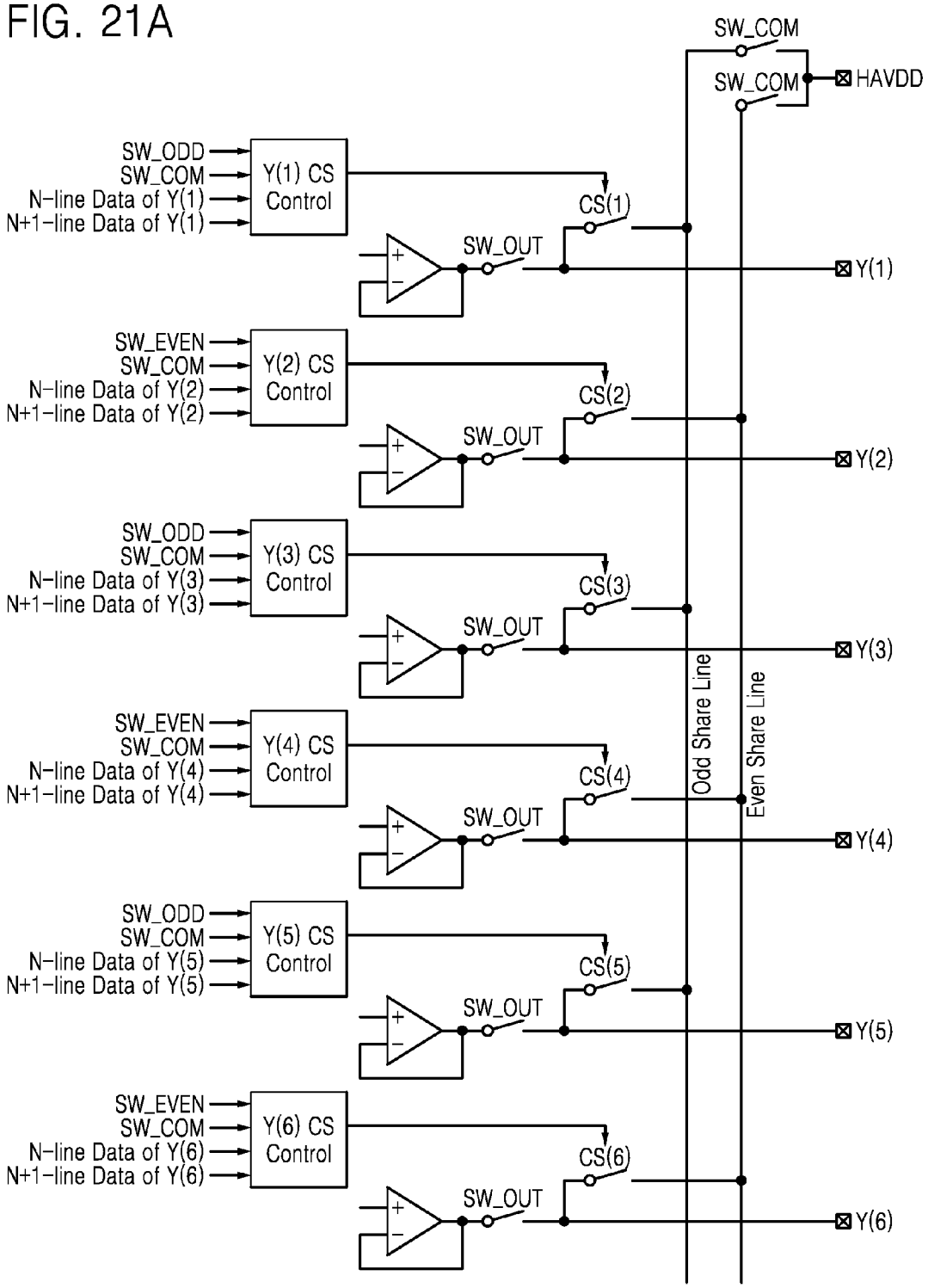
FIG. 21A is a block diagram of an exemplary channel buffer for performing a charge sharing method, according to one embodiment.

In some embodiments, the grouping of different source lines for charge sharing can be determined dynamically, and individually. FIG. 21A depicts an example where different source lines can be connected in even and odd groups, but where each source line can be individually included or not included in a group. In addition, FIG. 21A illustrates an example where the even and odd charge sharing lines can be connected.

FIG. 21A shows a channel buffer that may include some of the same elements as the buffer of FIG. 3, but that may provide for different combinations of source lines to be connected for charge sharing. For example, as shown in FIG. 21A, separate charge sharing switches CS(1) through CS(6) may each be individually connected between a buffer and a charge sharing line. A first group of switches (CS(1), CS(3), and CS(5) are coupled to the odd share line, and a second group of switches (CS(2), CS(4), and CS(6) are coupled to the even share line. In addition, the odd share line and even share line both connect to common switches SW_OUT. The CS switches may be controlled by circuitry (e.g., Y(1)-Y(6) CS Control blocks) that outputs a switch control signal in response to certain inputs, such as SW_ODD, SW_COM, and N-line and N+1-line data. As such, the channel buffer of FIG. 21A can be controlled such that source lines can be connected to each other for charge sharing in more flexible ways. For example, if one of the source lines frequently has a constant value, and therefore does not perform significant charge fluctuation, it may be excluded from a group that is performing charge sharing, to improve the power operation of the display module. The switches can be changed dynamically, based on an operation of the display module. As such, the source lines included in a group for charge sharing may depend on a determination of whether change amounts for the different source lines are above a threshold. Those source lines for which the change amounts are above the threshold can be included in a group, and those for which the change amounts are below the threshold can be excluded from the group.

Figure 21B:
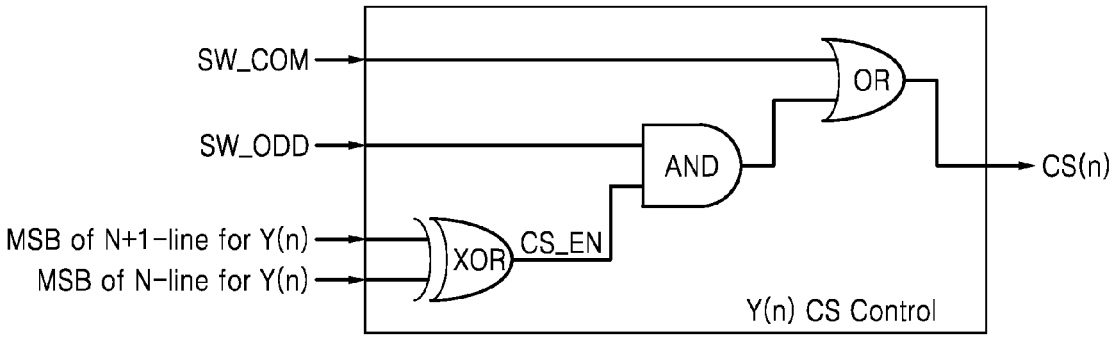
FIG. 21B is an exemplary logic gate diagram for implementing a charge sharing method such as shown in FIG. 21A, according to one embodiment.
Figure 21C:
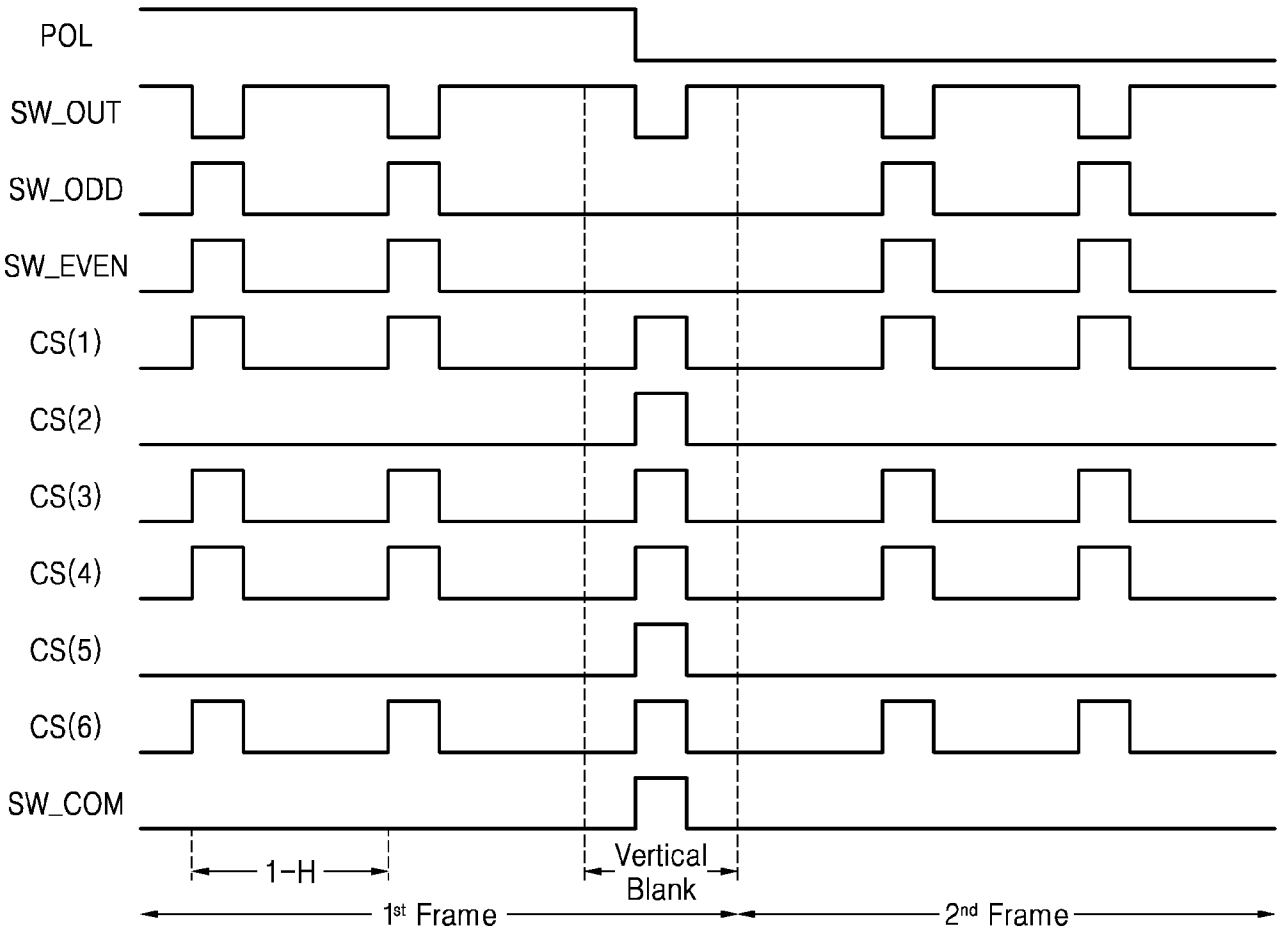
FIGS. 21C and 21D are exemplary timing diagrams showing an exemplary charge sharing method using the channel buffer of FIG. 21A, according to one exemplary embodiment.
Figure 21D:
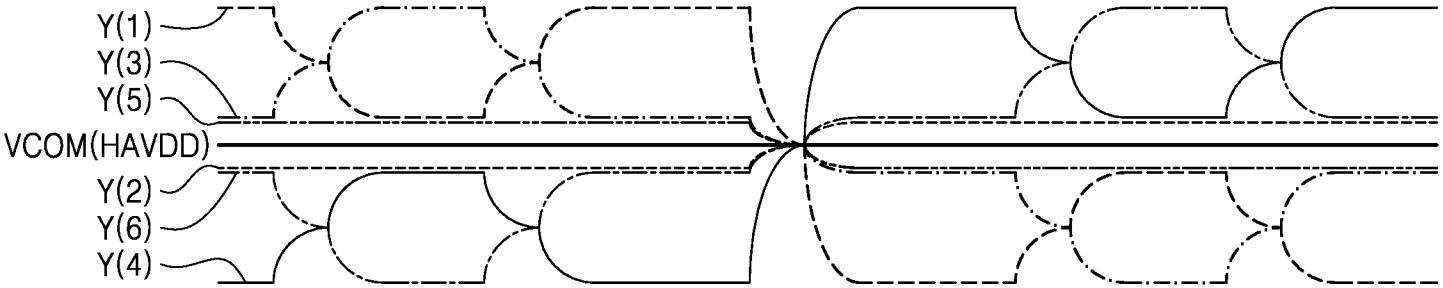

FIG. 21B shows an exemplary logic gate diagram for implementing a method such as disclosed in FIG. 21A, according to one embodiment. FIG. 21B depicts the CS Control circuits of FIG. 21A, according to certain embodiments. As shown in FIG. 21B, in one embodiment, for each source line, the most significant bit value is input to an XOR gate for each of two consecutive data lines. The output from the XOR operation for these two inputs is input to an AND gate along with the SW_ODD value, and an output from the AND gate is input to an OR gate along with the SW_COM. Therefore, when the ODD switch is on, charge sharing will occur between source lines coupled to the odd share line that have a fluctuation of at least the most significant bit amount between consecutive data lines.

FIGS. 21(*c*) and 21(*d*) show an example where two charge sharing switches CS(2) and CS(5) remain off when other charge sharing switches (CS(1), CS(3), CS(4), and CS(6) remain on during certain time periods. This occurs, for example, during horizontal blanking intervals. The switches may be set this way, for example, because the data on source lines Y(2) and Y(5) does not change state significantly between consecutive rows of data. In addition, the common switch SW_COM is turned on during the vertical blanking interval, and all charge sharing switches CS(1) through CS(6) are on, such that charge sharing occurs among all source lines during the vertical blanking interval.

Figure 22:
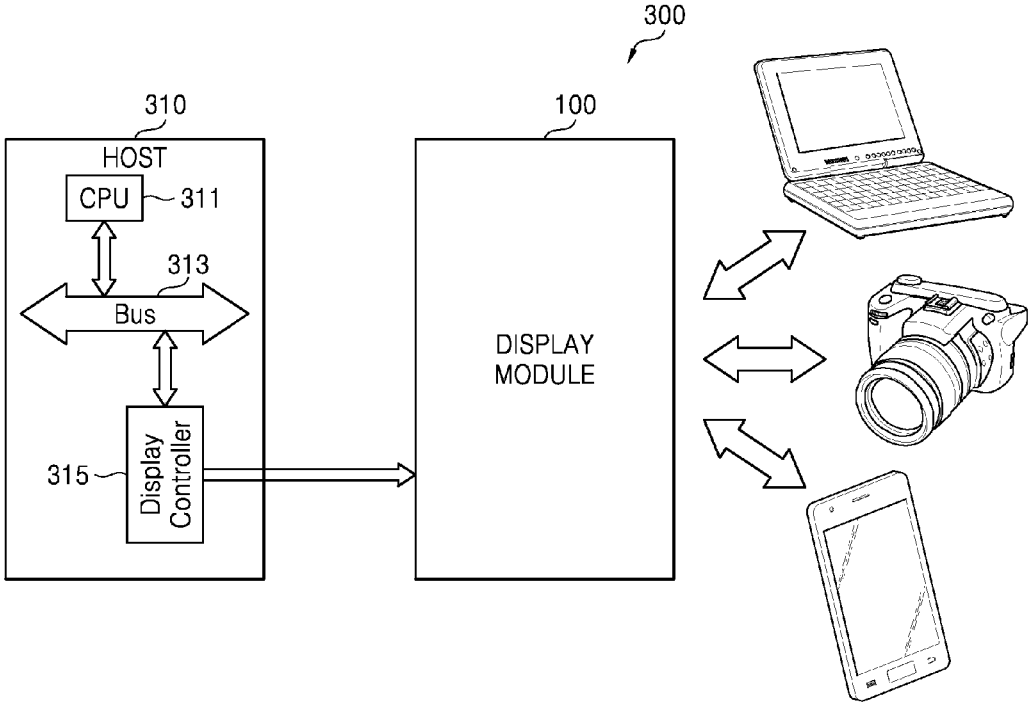
FIG. 22 is a block diagram of a portable electronic device including a display module according to each of the example embodiments of the present inventive concepts.

FIG. 22 is a block diagram of a portable electronic device including a display module according to one or more of the example embodiments. Referring to FIGS. 1 to 22, a portable electronic device 300 includes a host 310 and a display module 100A to 100H, which is collectively referred to as '100'.

The host 310 includes a CPU 311 and a display controller 315. The host 310 may be embodied in an application processor (AP) or a mobile application processor (mobile AP). The CPU 311 controls an operation of the display controller 315 through a bus 313.

The display controller 315 controls an operation of the display module 100. For example, the display controller 315 may control an operation of the timing controller 160A or 160B.

The portable electronic device 300 may be embodied, for example, in a portable device such as a laptop computer, a mobile phone, a smart phone, a tablet PC, a personal digital assistant (PDA), an enterprise digital assistant (EDA), a digital still camera, a digital video camera, a portable multimedia player (PMP), a personal navigation device or portable navigation device (PND), a handheld game console, an e-book, or a mobile internet device (MID).

A source driver according to example embodiments discussed herein may perform a charge sharing operation in every charge sharing interval on source lines transmitting pixel signals having the same polarity, thereby reducing power consumed in the source driver and a display driver IC including the source driver.

While the present disclosure has been described with reference to exemplary embodiments, it will be apparent to those skilled in the art that various changes and modifications may be made without departing from the spirit and scope of the present disclosure. Therefore, it should be understood that the above embodiments are not limiting, but illustrative.

What is claimed is:

1. A charge sharing method for a display driver that uses Z-inversion, the method comprising:

receiving a first row of data for a plurality of source lines;

receiving a second row of data for the plurality of source lines;

for each source line of the plurality of source lines, determining whether a change amount between data for that source line from the first row of data and data for that source line from the second row of data is above a threshold;

first controlling whether to perform charge sharing among a first group of source lines of the plurality of source lines based on the determinations for that first group of source lines;

second controlling whether to perform charge sharing among a second group of source lines of the plurality of source lines based on the determinations for that second group of source lines, wherein the first controlling includes controlling connection between a first charge sharing line and each of the first group of source lines, wherein the second controlling includes controlling connection between a second charge sharing line and each of the second group of source lines, and wherein the connection between the first charge sharing line and at least one source line of the first group of source lines is independent from the connection between the second charge sharing line and at least one source line of the second group of source lines; and based on the determinations for the first group of source lines;

counting a first number of determinations for which a charge associated with the data for a respective source line increases more than a first threshold amount;

counting a second number of determinations for which a charge associated with the data for a respective source line decreases more than a second threshold amount; and controlling whether to perform the charge sharing for the first group of source lines based on the first number of determinations and the second number of determinations.

2. The charge sharing method of claim 1, wherein:

the first group of source lines includes only odd-numbered source lines of the display driver; and the second group of source lines includes only even-numbered source lines of the display driver.

3. The charge sharing method of claim 1, wherein:

the first group of source lines includes source lines that share a first polarity during operation of the source driver; and the second group of source lines includes source lines that share a second polarity opposite the first polarity during operation of the source driver.

4. The charge sharing method of claim 1, further comprising:

dynamically selecting the first group of source lines based on the determinations for the plurality of source lines.

5. The charge sharing method of claim 1, wherein:

the first reference value is a predetermined percentage of the total number of source lines of the first group of source lines; and the second reference value is a predetermined percentage of the total number of source lines of the first group of source lines.

6. The charge sharing method of claim 1, further comprising:

performing the charge sharing when the first number of determinations is above a first reference value and the second number of determinations is above a second reference value.

7. The charge sharing method of claim 6, wherein the first reference value is the same as the second reference value.

8. A charge sharing method for a display driver, the method comprising:

receiving a first row of data for a first row of source lines;

receiving a second row of data for a second row of source lines;

for each source line of at least a first group of the source lines, first determining whether a change amount between data for that source line from the first row of data and data for that source line from the second row of data is above a threshold;

for each source line of at least a second group of the source lines, second determining whether a change amount between data for that source line from the first row of data and data for that source line from the second row of data is above a threshold;

performing selective charge sharing based on the determinations for the first group of source lines and second group of source lines, wherein the performing includes at least one of first controlling connection between a first charge sharing line and each of the first group of source lines, and second controlling connection between a second charge sharing line and each of the second group of source lines, and wherein the connection between the first charge sharing line and at least one source line of the first group of source lines is independent from the connection between the second charge sharing line and at least one source line of the second group of source lines; and based on the determinations for the first group of source lines:

counting a first number of determinations for which a charge associated with the data for a respective source line increases more titan a first threshold amount;

counting a second number of determinations for which a charge associated with the data for a respective source line decreases more than a second threshold amount: and controlling whether to perform the charge sharing for the first group of source lines based on the first number of determinations and the second number of determinations.

9. The charge sharing method of claim 8, wherein:

performing selective charge sharing includes selecting a group of source lines to be connected to each other for a charge sharing operation.

10. The charge sharing method of claim 8, wherein:

the first group of source lines includes only odd-numbered source lines of the display driver; and the second group of source lines includes only even-numbered source lines of the display driver.

11. The charge sharing method of claim 8, wherein:

the first group of source lines includes source lines that share a first polarity during operation of the source driver; and the second group of source lines includes source lines that share a second polarity opposite the first polarity during operation of the source driver.

12. The charge sharing method of claim 8, wherein:

performing selective charge sharing includes selecting whether or not to perform charge sharing based on the determinations for the first group of source lines and second group of source lines.

13. The charge sharing method of claim 12, wherein:

performing selective charge sharing includes, during each of a plurality of blanking intervals, selecting whether or not to perform charge sharing.

14. The charge sharing method of claim 8, further comprising:

performing the charge sharing when the first number of determinations is above a first reference value and the second number of determinations is above a second reference value.

15. The charge sharing method of claim 14, wherein the first reference value is the same as the second reference value.

16. A charge sharing method for a display driver that includes a plurality of first source lines coupled to a respective plurality of first buffers through a respective plurality of first switches, a plurality of second source lines coupled to a respective plurality of second buffers through a respective plurality of second switches, a plurality of third switches respectively coupled to the plurality of first buffers and a plurality of fourth switches respectively coupled to the plurality of second buffers, a first charge sharing line, and a second charge sharing line, the method comprising:

receiving a first set of data at the plurality of first source lines and a second set of data at the plurality of second source lines at a first period of time when each of the plurality of third switches and each of the plurality of fourth switches are in a first state that causes the first charge sharing line and the second charge sharing line to be disconnected from the plurality of first source lines and plurality of second source lines;

for each source line of the plurality of first source lines and the plurality of second source lines, determining whether a change amount between data of a particular set of data for that source line and data of a next set of data for that source line is above a threshold; and based on the determining for the plurality of first source lines:

counting a first number of determinations for which a charge associated with the data for a respective source line increases more than a first threshold amount;

counting a second number of determinations for which a charge associated with the data for a respective source line decreases more than a second threshold amount; and controlling whether to perform the charge sharing for the plurality of first source lines based on the first number of determinations and the second number of determinations, wherein charge sharing includes changing the state of each of the plurality of third switches and each of the plurality of fourth switches to a second state to cause the plurality of first source lines to connect to the first charge sharing line and the plurality of second source lines to connect to the second charge sharing line, wherein the plurality of first source lines are electrically connected to the first charge sharing line through respective ones of the third switches, and the plurality of second source lines are electrically connected to the second charge sharing line through respective ones of the fourth switches and are not connected to the first charge sharing line through the third switches.

17. The method of claim 16, wherein:

the changed state of each of the plurality of first switches and each of the plurality of second switches occurs during a blanking interval following the first period of time.

* * * * *